US010013992B2

(12) United States Patent
Spanias et al.

(10) Patent No.: US 10,013,992 B2
(45) Date of Patent: Jul. 3, 2018

(54) FAST COMPUTATION OF EXCITATION PATTERN, AUDITORY PATTERN AND LOUDNESS

(71) Applicants: Andreas Spanias, Tempe, AZ (US); Girish Kalyanasundaram, Eden Prairie, MN (US)

(72) Inventors: Andreas Spanias, Tempe, AZ (US); Girish Kalyanasundaram, Eden Prairie, MN (US)

(73) Assignee: Arizona Board of Regents on Behalf of Arizona State University, Scottsdale, AZ (US)

( * ) Notice: Subject to any disclaimer, the term of this patent is extended or adjusted under 35 U.S.C. 154(b) by 0 days.

(21) Appl. No.: 15/325,589

(22) PCT Filed: Jul. 13, 2015

(86) PCT No.: PCT/US2015/040142

§ 371 (c)(1),
(2) Date: Jan. 11, 2017

(87) PCT Pub. No.: WO2016/007947

PCT Pub. Date: Jan. 14, 2016

(65) Prior Publication Data

US 2017/0162209 A1 Jun. 8, 2017

Related U.S. Application Data

(60) Provisional application No. 62/023,443, filed on Jul. 11, 2014.

(51) Int. Cl.
*H04R 29/00* (2006.01)
*G10L 19/08* (2013.01)
(Continued)

(52) U.S. Cl.
CPC ..... *G10L 19/08* (2013.01); *G10L 19/26* (2013.01); *G10L 25/21* (2013.01); *H04R 25/353* (2013.01);
(Continued)

(58) Field of Classification Search
CPC .... H04R 25/02; H04R 25/353; H04R 25/356; H04R 25/48; H04R 25/50; H04R 25/652;
(Continued)

(56) References Cited

U.S. PATENT DOCUMENTS 8,392,198 B1 3/2013 Berisha et al.
8,437,482 B2 5/2013 Seefeldt et al.
(Continued)

OTHER PUBLICATIONS

Author Unknown, "Sound Quality Assessment Material recordings for subjective tests," Users' handbook for the EBU SQAM CD, Tech 3253, Sep. 2008, 13 pages.
(Continued)

*Primary Examiner* — Xu Mei
(74) *Attorney, Agent, or Firm* — Withrow & Terranova, P.L.L.C.

(57) ABSTRACT

A method includes the steps of calculating a power spectrum from an auditory stimulus, filtering the power spectrum to obtain an effective power spectrum, calculating an intensity pattern from the effective power spectrum, calculating a median intensity pattern from the intensity pattern, determining an initial set of pruned detector locations, examining the initial set of pruned detector locations to determine an enhanced set of pruned detector locations, and calculating an excitation pattern from the effective power spectrum using the enhanced set of pruned detector locations. By determining the enhanced set of pruned detector locations from the initial set of pruned detector locations and computing the excitation pattern therefrom, the computational complexity of the above method can be significantly reduced when
(Continued)

compared to conventional approaches while maintaining the accuracy thereof.

20 Claims, 20 Drawing Sheets

(51) Int. Cl.
*G10L 19/26* (2013.01)
*G10L 25/21* (2013.01)
*H04R 25/00* (2006.01)

(52) U.S. Cl.
CPC ..... *H04R 25/356* (2013.01); *H04R 25/48* (2013.01); *H04R 25/50* (2013.01)

(58) Field of Classification Search
CPC . H04R 25/75; H04R 2225/00–2225/83; G10L 19/08; G10L 19/26; G10L 25/21
USPC ..... 381/60, 316, 321, 328, 94.1–94.3, 98; 607/55, 57; 600/25, 559
See application file for complete search history.

(56) References Cited

U.S. PATENT DOCUMENTS

| | | | | |
|---|---|---|---|---|
| 9,055,374 | B2 * | 6/2015 | Krishnamoorthi ..... | H04R 29/00 |
| 9,306,524 | B2 * | 4/2016 | Smithers ..... | H03G 9/005 |
| 9,590,580 | B1 * | 3/2017 | You ..... | H03G 3/32 |
| 2007/0121966 | A1 * | 5/2007 | Plastina ..... | H03G 7/007 381/104 |
| 2011/0150229 | A1 | 6/2011 | Krishnamoorthi et al. | |
| 2011/0257982 | A1 | 10/2011 | Smithers | |
| 2012/0163629 | A1 | 6/2012 | Seefeldt | |
| 2013/0243222 | A1 | 9/2013 | Crockett et al. | |
| 2014/0074184 | A1 | 3/2014 | Litvak | |

OTHER PUBLICATIONS

Fastl, Hugo, et al., "Pscyhoacoustics: Facts and Models," (Book), Third Edition, Springer Series in Information Science, Springer-Verlag, 2006, 471 pages.

Glasberg, Brian, et al., "Derivation of auditory filter shapes from notched-noise data," Hearing Research, vol. 47, 1990, Elsevier Science Publishers B.V., pp. 103-138.

Kalyanasundaram, Girish, et al., "Audio Processing and Loudness Estimation Algorithms with iOS Simulations," Masters Thesis, Arizona State University, Dec. 2013, 161 pages.

Krishnamoorthi, Harish, et al., "A low-complexity loudness estimation algorithm," International Conference on Acoustics, Speech, and Signal Processing, Mar. 2008, Las Vegas, Nevada, IEEE, 4 pages.

Krishnamoorthi, Harish, et al., "A Frequency/Detector Pruning Approach for Loudness Estimation," IEEE Signal Processing Letters, vol. 16, Issue 11, Nov. 2009, IEEE, pp. 997-1000.

International Preliminary Report on Patentability for PCT/US2015/040142, dated Jan. 26, 2017, 9 pages.

International Search Report and Written Opinion for PCT/US2015/040142, dated Sep. 23, 2015, 13 pages.

* cited by examiner

FAST COMPUTATION OF EXCITATION PATTERN, AUDITORY PATTERN AND LOUDNESS

RELATED APPLICATIONS

This application is a 35 U.S.C. § 371 national phase filing of International Application No. PCT/US15/40142, filed Jul. 13, 2015, which claims priority to U.S. Provisional Application No. 62/023,443, filed Jul. 11, 2014, the disclosures of which are incorporated herein by reference in their entireties.

FIELD OF THE DISCLOSURE

The present disclosure relates to computationally efficient methods for calculating an excitation pattern, an auditory pattern, and/or a loudness.

BACKGROUND

Loudness is the intensity of sound as perceived by a listener. The human auditory system, upon reception of an auditory stimulus, produces neural electrical impulses, which are transmitted to the auditory cortex in the brain. The perception of loudness is inferred in the brain. Hence, loudness is a subjective phenomenon. Loudness, as a quantity, is therefore different from the measure of sound pressure level in dB SPL. Through experiments on test subjects (also referred to as psychophysical experiments), it has been found that different signals produce different sensitivities in a human listener, because of which different sounds having the same sound pressure level can each have a different perceived loudness. Accordingly, quantifying loudness requires incorporation of knowledge of the working human auditory sensory system. Generally, methods to quantify loudness are based on psychoacoustic models that mathematically characterize the properties of the human auditory system.

Early attempts to quantify loudness were based on subjective judgments by human test subjects, and suffered from various accuracy problems. In an attempt to create an "absolute" scale for loudness (i.e., a scale where when the measure of loudness is scaled by a number 'x', the perceived loudness by a listener should also be scaled by the factor 'x'), auditory pattern based loudness estimation was developed. One notable auditory pattern based loudness estimation model is the Moore-Glasberg method. A flow diagram illustrating the Moore-Glasberg method is shown in FIG. 1. First, a power spectrum of an auditory stimulus (i.e., a sound) is determined (step 100). This may be accomplished by performing a Fourier transform or a fast Fourier transform on the auditory stimulus. Next, an effective power spectrum is determined by applying a filter response representative of the response of the outer and middle ear to the power spectrum (step 102). An excitation pattern is then determined from the effective power spectrum by applying a filter response representative of the response of the basilar membrane of the ear in the cochlea along its length to the effective power spectrum via a full calculation method that is discussed in detail below (step 104). Generally, the response of the basilar membrane is approximated with a bank of bandpass filters, each of which are referred to herein as "detectors". These detectors are evenly spaced throughout an auditory frequency range at a number of detector locations, and the total energy of the signals produced by the detectors comprise the excitation pattern. A specific loudness is then determined from the excitation pattern (step 106), and a total loudness is determined from the specific loudness (step 108). This measure of loudness is also referred to as instantaneous loudness. An averaged measure of the instantaneous loudness, referred to as the short-term loudness, may be determined from the total loudness (step 110). Further, an averaged measure of the short-term loudness, referred to as the long-term loudness, may be determined from the short-term loudness (step 112). Details of each one of the steps of the Moore-Glasberg method are discussed below.

FIG. 2 shows details of step 104 discussed above in FIG. 1. In order to determine the excitation pattern, an intensity pattern is determined from the effective power spectrum (step 104A). Details of determining the intensity pattern are discussed below. Next, an excitation at each one of a large number of detector locations is determined to obtain the excitation pattern (step 104B). The large number of detector locations are equally spaced within an auditory frequency range with high enough resolution to accurately determine the excitation pattern. Generally, the large number of detector locations used in such a determination greatly increases the computational complexity of the Moore-Glasberg method, as discussed in detail below.

The human outer ear accepts an auditory stimulus and transforms it as it is transferred to the eardrum. The transfer function of the outer ear is defined as the ratio of sound pressure of the stimulus at the eardrum to the free-field sound pressure of the stimulus. The outer ear response used in the Moore-Glasberg method is derived from stimuli incident from a frontal direction. Other angles of incidence would require correction factors in the response. The free-field sound pressure is the measured sound pressure at the position of the center of the listener's head when the listener is not present. The outer ear can thus be modeled as a linear filter, whose response is shown in FIG. 3. As it can be observed, the resonance of the outer ear canal at about 4 kHz results in the sharp peak around the same frequency in the response.

The middle ear transformation provides an important contribution to the increase in the absolute threshold of hearing at lower frequencies. The middle ear essentially attenuates the lower frequencies. The middle ear functions in this manner to prevent the amplification of the low level internal noise at the lower frequencies. These low frequency internal noises commonly arise from heartbeats, pulse, and activities of muscles. Hence, it is assumed in the Moore-Glasberg method that the middle ear has equal sensitivity to all frequencies above 500 Hz. Further, it is assumed that below 500 Hz the response of the middle ear filter is roughly the inverted shape of the absolute threshold curve at the same frequencies.

The combined outer and middle ear filter's magnitude frequency response is shown in FIG. 4. Such a filter response is used in step 102 described above. An input sound x(n) with a power spectrum $S_x(\omega_i)$ (where $$\omega_i = \exp\left(\frac{j2\pi f_i}{f_s}\right)$$

when me sampling frequency is $f_s$) is processed with the combined outer-middle ear filter. If the frequency response of the outer-middle ear filter is $M(\omega_i)$, then the output power spectrum of the filter is $S_x^c(\omega_i)=|M(\omega_i)|^2 S_x(\omega_i)$. This spectrum $S_x^c(\omega_i)$ reaches the inner ear and is referred to as the effective spectrum.

The basilar membrane receives the stimulating signal filtered by the outer and middle ear to produce mechanical vibrations. Each point on the membrane is tuned to a specific frequency and has a narrow bandwidth of response around that frequency. Hence, each location on the membrane acts as a "detector" of a particular frequency. To model this response, a bank of bandpass filters is used. Each filter represents the response of the basilar membrane at a specific location on the membrane. The combined filter response of the bank of bandpass filters is modeled as a rounded exponential filter, and the rising and falling slopes of the combined filter response are dependent upon the intensity level of the signal at the corresponding frequency band.

The detector locations on the membrane are represented on an auditory scale measured by an equivalent rectangular bandwidth (ERB) at each frequency. For a given center frequency f, the equivalent rectangular bandwidth is given by Equation (1):

$$ERB(f) = 24.67\left(\frac{4.37f}{1000} + 1\right) \tag{1}$$

The bandpass filters are represented on an auditory scale derived from the center frequencies of the filters. This auditory scale represents the frequencies based on their ERB values. Each frequency is mapped to an "ERB number", because of which it is also referred to as the ERB scale. The ERB number for a frequency represents the number of ERB bandwidths that can be fitted below the same frequency. The conversion of frequency to the ERB scale is through the following expression. Here, f is the frequency in Hz, which maps to d in the ERB scale as shown in Equation (2):

$$d(\text{in } ERB \text{ units}) = 21.4\log_{10}\left(\frac{4.37f}{1000} + 1\right) \tag{2}$$

Let D be the number of auditory filters that are used to represent responses of discrete locations of the basilar membrane. Let $L_r=\{d_k \| d_k-d_{k-1}|=0.1, k=1, 2 \ldots D\}$ be the set of detector locations equally spaced at a distance of 0.1 ERB units on the ERB scale. Each detector represents the center frequency of the corresponding bandpass filter. The magnitude frequency response of the bandpass filter at a detector location $d_k$ is defined in Equation (3) as:

$$W(k,i)=(1+p_{k,i}g_{k,i})\exp(-p_{k,i}g_{k,i}), k=1, \ldots D \text{ and } i=1, \ldots N \tag{3}$$

where $p_{k,i}$ is the slope of the auditory filter corresponding to the detector $d_k$ at frequency $f_i$ and $g_{k,i}=|(f_i-f_{c_k})/f_{c_k}|$ is the normalized deviation of the frequency component $f_i$ from the center frequency $f_{c_k}$ of the detector.

The auditory filter slope $p_{k,i}$ is dependent on the intensity level of the effective spectrum of the signal within the equivalent rectangular bandwidth around the center frequency of that detector. The intensity pattern, I(k), is the total intensity of the effective power spectrum within one ERB around the center frequency of the detector $d_k$, as shown in Equation (4):

$$I(k) = \sum_{i \in A_k} S_x^c(\omega_i), \tag{4}$$

-continued $$A_k = \left\{ i \,\middle|\, d_k - 0.5 < 21.4\log_{10}\left(\frac{4.37f_i}{1000} + 1\right) \le d_k + 0.5, i = 1, \ldots N \right\}$$

Accordingly, determining the intensity pattern from the effective power spectrum as in step 104A of FIG. 2 may involve solving Equation (4). As known through experiments, an auditory filter has different slopes for the lower and upper skirts of the filter response. In the Moore-Glasberg method, the slope of the lower skirt $p_k^l$ is dependent on the corresponding intensity pattern value, but the slope of the upper skirt $p_k^u$ is fixed. The parameters are given by Equation (5) and Equation (6):

$$p_{k,i}^l = p_k^{51} - 0.38\left(\frac{p_k^{51}}{p_{100}^{51}}\right)(I(i) - 51) \tag{5}$$

$$p_{k,i}^u = p_k^{51} \tag{6}$$

In the above equations, $p_k^{51}$ is the value of $p_{k,i}$ at the corresponding detector location when the intensity I(i) is at a level of 51 dB. It can be computed as shown in Equation (7):

$$p_k^{51} = \frac{4f_{c_k}}{ERB(f_{c_k})} \tag{7}$$

Thus, it can be seen that the slope of the lower skirt matches the auditory filter that is centered at a frequency of 1 kHz, when the effective spectrum of the auditory stimulus has an intensity of 51 dB at the same critical band. The slope $p_{k,i}$ chooses the lower skirt and the upper skirt according to Equation (8):

$$p_{k,i} = \begin{cases} p_{k,i}^l, & g_{k,i} < 0 \\ p_{k,i}^u, & g_{k,i} \ge 0 \end{cases} \tag{8}$$

The excitation pattern is thus evaluated from Equation (9) and Equation (10):

$$E(k) = \sum_{i=1}^{D} W(k, i).S_x^c(\omega_i), k = 1, \ldots D \text{ and } i = 1, \ldots N \tag{9}$$

$$= \sum_{i=1}^{D} (1 + p_{k,i}g_{k,i})\exp(-p_{k,i}g_{k,i}), k = 1, \ldots D \text{ and } i = 1, \ldots N \tag{10}$$

Accordingly, determining the excitation pattern as in step 104B in FIG. 2 may involve solving Equation (9) and Equation (10). As discussed above, the specific loudness pattern represents the neural excitations generated by hair cells, which convert basilar membrane vibrations at each point along its length (which is the excitation pattern) to electrical impulses. The specific loudness, or partial loudness is a measure of the perceived loudness per ERB, and is computed from the excitation pattern as per the Equation (11):

$$S(k)=c((E(k)+A(k))^\alpha-A^\alpha(k)) \text{ for } k=1, \ldots D \tag{11}$$

where the constants are chosen as c=0.047 and $\alpha$=0.2. It can be observed that the specific loudness pattern is derived through a non-linear compression of the excitation pattern. A(k) is a frequency dependent constant which is equal to twice the peak excitation pattern produced by a sinusoid at absolute threshold, which is denoted by $E_{THRQ}$ (i.e., $A(k)=2E_{THRQ}(k)$). It can be inferred from this expression that the specific loudness is greater than zero for any sound, even if below the absolute threshold of hearing. Hence, the total loudness, which would be derived by integrating the specific loudness over the ERB scale, will also be positive for any sound. At frequencies greater than or equal to 500 Hz, the value of $E_{THRQ}$ is constant. For frequencies lesser than 500 Hz, the cochlear gain is reduced, hence, increasing the excitation $E_{THRQ}$ at the corresponding frequencies. This can be modeled as a gain g for each frequency, relative to the gain at 500 Hz and above (the gain at and above 500 Hz is constant), acting on the excitation pattern. It is assumed that the product of g and $E_{THRQ}$ is constant. The specific loudness pattern is then expressed in Equation (12):

$$S(k)=c((gE(k)+A(k))^{\alpha}-A^{\alpha}(k)) \text{ for } k=1, \ldots D \tag{12}$$

The rate of decrease of specific loudness is higher when the stimulus is below absolute threshold than what is predicted in Equation (12). This is modeled by introducing an additional factor dependent on the excitation pattern strength. Hence, if $E(k)<E_{THRQ}(k)$, Equation (13) holds for the specific loudness pattern:

$$S(k) = c\left(\frac{E(k)}{E(k)+E_{THRQ}(k)}\right)^{1.5}((gE(k)+A(k))^{\alpha}-A^{\alpha}(k)) \tag{13}$$

Similarly, when the intensity is higher than 100 dB, the rate of increase of specific loudness is higher, and is modeled by Equation (14), which is valid when $E(k)>10^{10}$:

$$S(k) = c\left(\frac{E(k)}{1.04\times10^{6}}\right)^{0.5} \tag{14}$$

Hence, putting together Equations (12), (13) and (14), the specific loudness function can be expressed as in Equation (15), where the constant $1.04\times10^{6}$ is chosen to make S(k) continuous at $E(k)=10^{10}$:

$$S(k) = \begin{cases} c((gE(k)+A(k))^{\alpha}-A^{\alpha}(k)),\ E(k)<E_{THRQ}(k) \\ c\left(\frac{E(k)}{E(k)+E_{THRQ}(k)}\right)^{1.5}((gE(k)+A(k))^{\alpha}-A^{\alpha}(k)), \\ \quad E_{THRQ}(k)\le E(k)\le 10^{10} \\ c\left(\frac{E(k)}{1.04\times10^{6}}\right)^{0.5},\ E(k)>10^{10} \end{cases} \tag{15}$$

Accordingly, determining the specific loudness from the excitation pattern as in step 106 of FIG. 1 may involve solving any of Equations (11)-(15).

The total loudness is computed by integrating the specific loudness pattern S(k) over the ERB scale, or computing the area under the loudness pattern. While implementing the model with a discrete number of detectors, the computation of the area under the specific loudness pattern can be performed by evaluating the area of trapezia formed by successive points on the pattern along with the x-axis (which is the ERB scale). The loudness can then be computed using Equation (16) and Equation (17):

$$L=\sum_{k=1}^{D-1}\left[S(k)\delta_d+\frac{1}{2}(S(k+1)-S(k))\delta_d\right] \tag{16}$$

$$L=\delta_d\left[\sum_{k=2}^{D-1}S(k)+\frac{1}{2}(S(1)+S(D))\right] \tag{17}$$

Accordingly, determining the total loudness from the specific loudness as in step 108 of FIG. 1 may involve solving Equations (16) and (17). The loudness computed in this manner quantifies the loudness perceived when a stimulus is presented to one ear (the monaural loudness). The binaural loudness can be computed by summing the monaural loudness of each ear.

The measure of loudness derived above is also referred to as the instantaneous loudness, as it is the loudness for a short segment of an auditory stimulus. This measure of loudness is constant only when the input sound has a steady spectrum over time. Signals in reality are time-varying in nature. Such sounds exhibit temporal masking, which results in fluctuating values of the instantaneous loudness. Hence, it is important to derive metrics of loudness that are steadier for time-varying sounds.

Loudness estimation for time-varying sounds has been performed by suitably capturing variations in the signal power spectrum to account for the temporal masking. The power spectrum is computed over segments of the signals windowed with different lengths (e.g., 2, 4, 6, 8, 16, 32 and 64 milliseconds). Then, particular frequency components are selected from the obtained spectra to get the best trade-off time and frequency resolutions. The spectrum is updated every 1 ms, by shifting the windowing frame by 1 ms every time. The steady state spectrum hence derived is processed with the Moore-Glasberg method described above and the instantaneous loudness is computed.

The short-term loudness is calculated by averaging the instantaneous loudness using a one-pole averaging filter. The long-term loudness is calculated by further averaging the short-term loudness using another one-pole filter. The short-term loudness smoothes the fluctuations in the instantaneous loudness, and the long-term loudness reflects the memory of loudness over time. The filter time constants are different for rising and falling loudness. This models the non-linearity of accumulation of loudness perception over time. During an attack (i.e., a sudden increase in loudness), loudness rapidly accumulates, unlike reducing loudness, which is more gradual. If L(n) denotes the instantaneous loudness of the $n^{th}$ frame, then the short-term loudness $L_s(n)$ at the $n^{th}$ frame is given by Equation (18) and Equation (19), where $\alpha_a$ and $\alpha_r$ are the attack and release parameters respectively:

$$L_l(n) = \begin{cases} \alpha_a L(n)+(1-\alpha_a)L_s(n-1),\ L(n)>L_s(n-1) \\ \alpha_r L(n)+(1-\alpha_r)L_s(n-1),\ L(n)\le L_s(n-1) \end{cases} \tag{18}$$

$$\alpha_a = 1-e^{-\frac{T_i}{T_a}},\ \alpha_r = 1-e^{-\frac{T_i}{T_r}} \tag{19}$$

where the value $T_i$ denotes the time interval between successive frames, and $T_a$ and $T_r$ are the attack and release time constants respectively. Accordingly, determining the short-term loudness from the total loudness as in step 110 of FIG.

1 may involve solving Equations (18) and (19). Similarly, the long-term loudness $L_l(n)$ can be computed from Equation (20):

$$L_l(n) = \begin{cases} \alpha_{l_a} L_s(n) + (1-\alpha_{l_a})L_l(n-1), & L_s(n) > L_l(n-1) \\ \alpha_{l_r} L_s(n) + (1-\alpha_{l_r})L_l(n-1), & L_s(n) \le L_l(n-1) \end{cases} \quad (20)$$

Accordingly, determining the long-term loudness from the short-term loudness as in step 112 of FIG. 1 may involve solving Equation (20).

While the Moore-Glasberg method discussed above often provides a relatively accurate estimation of loudness, the complexity of the calculations discussed above require a significant amount of processing power. Given a frame of N samples of an input signal x(n), the computation of the N-point FFT, and hence, the power spectrum of the signal $\{S_x(\omega_i)\}_{i=1}^{N}$ of the signal has a complexity of $\Theta(N \log N)$, where N is size of the FFT. The effective power spectrum reaching the inner ear $S_x^c(\omega_i)$ is computed by filtering the spectrum $S_x(\omega_i)$ through the outer-middle ear filter $M(\omega_i)$. In the dB scale, this reduces to additions of the magnitudes of the signal power spectrum and the filter response, which has a complexity of $\Theta(N)$. The determination of the intensity pattern I(k) has a complexity of $\Theta(D)$, where D is the number of detectors. The subsequent computation of the auditory filter slopes $p_k$ also has a complexity of $\Theta(D)$. The computation of the auditory filter responses $\{W(k,i)\}_{k=1,i=1}^{D,N}$ has a complexity of $\Theta(ND)$. Then, the auditory filter operates on the effective spectrum to determine the excitation pattern E(k), which also has a complexity $\Theta(ND)$. The computation of the specific loudness pattern S(k) from the excitation pattern has a complexity of $\Theta(D)$. The step of integrating the specific loudness pattern to estimate the total instantaneous loudness L also has a complexity of $\Theta(D)$. The final steps of computing the short-term and long-term loudness require a constant number of operations and hence, have a complexity of $\Theta(1)$.

It can be seen from the above analysis that the steps of computing the auditory filter responses and the filtering of the effective spectrum with the auditory filters has the highest complexity of $\Theta(ND)$. Accordingly, computing the excitation pattern according to conventional methods is computationally expensive. Several applications such as sinusoidal selection based analysis-synthesis, speech enhancement, bandwidth extension, and rate determination make use of auditory patterns. It is therefore beneficial to reduce the complexity of estimating excitation patterns and auditory patterns. Although there have been attempts to reduce the complexity of estimating excitation patterns and auditory patterns, such methods generally come at the expense of accuracy.

In an effort to reduce the computational load of the Moore-Glasberg method, approaches such as frequency pruning and detector pruning have been proposed. Frequency pruning involves reducing the number of frequency components in an auditory stimulus to approximate the spectrum with only a few components such that the total loudness is preserved. That is, one can choose to retain a subset of frequencies $\{f_i\}_{i=1}^{N}$ for computing the excitation pattern. In the other case, the set of detectors $\{d_k\}_{k=1}^{D}$ can be pruned to choose only a subset of detector locations for evaluating the excitation pattern $\{E(k)\}_{k=1}^{D}$. This approach is referred to as detector pruning, and is synonymous to non-uniformly sampling the excitation pattern along the basilar membrane to capture its shape.

Pruning the frequency components in the spectrum can be performed by using a quantity called the averaged intensity pattern. The average intensity pattern Y(k) is computed by filtering the intensity pattern, as show in equation (21), where the average intensity pattern is a measure of the average intensity per ERB:

$$Y(k) = \frac{1}{11}\sum_{i=-5}^{5} I(k-i) \quad (21)$$

This allows the spectrum to be divided into tonal bands and non-tonal bands. Tonal bands are ERBs in which only a dominant spectral peak is present. The intensity pattern in these bands is quite flat, with a sudden drop at the edge of the ERB around the tone. The tonal bands can be represented by just the dominant tone, ignoring the remaining components. These tonal bands are identified as the locations of the maxima of the average intensity pattern Y(k), as shown in FIGS. 5A and 5B. Specifically, FIG. 5A shows an intensity pattern determined from an effective power spectrum of an auditory stimulus as discussed above and the average intensity pattern determined therefrom. FIG. 5B shows the effective power spectrum of the auditory stimulus and a number of tonal bands identified therein, which correspond to the maxima of the average intensity pattern shown in FIG. 5A.

The portions of the spectrum which do not qualify as tonal bands are labeled as non-tonal bands. Each non-tonal band is further divided into smaller bins $B_{1:Q}$ of width 0.25 ERB units (Cam), where Q is the number of sub-bands in the non-tonal band. Each sub-band $B_p$ is assumed to be approximately white. From this assumption, each sub-band $B_p$ is represented by a single frequency component $\hat{S}_p$, which is equal to the total intensity within that band. If $M_p$ is the indices of frequency components within $B_p$, then $\hat{S}_p$ is given by Equation (22):

$$\hat{S}_p = \sum_{j \in M_p} S_x^c(\omega_j) \quad (22)$$

This method of dividing the spectrum into smaller bands and representing each band with a single equivalent spectral component is justified, as it preserves the energy within each critical band and consequently, preserves the auditory filter shapes and their responses. Spectral bins smaller than 0.25 ERB may also be chosen for non-tonal bands, but it would result in less efficient frequency pruning.

The excitation at a detector location is the energy of the signal filtered by the bandpass filter at that detector location. Since the intensity pattern at a detector defined in Equation (4) is the energy within the bandwidth of the detector, the intensity pattern would have some correlation with the excitation pattern. This is illustrated by the plot shown in FIGS. 6A through 6C. It can be observed that for the given auditory stimulus in FIG. 6A, the shape of the excitation pattern in FIG. 6B is to a significant extent, dictated by the intensity pattern in FIG. 6C, wherein the peaks and valleys of the excitation pattern largely follow the peaks and valleys in the intensity pattern.

Detector pruning has conventionally been accomplished by choosing detectors from salient points based on the averaged intensity pattern. Accordingly, FIG. 7A shows an intensity pattern determined from an effective power spectrum of an auditory stimulus as discussed above and the average intensity pattern determined therefrom. The detectors at the locations of the peaks and valleys of the averaged intensity pattern are chosen for explicit computation. If the reference set of detectors is $L_T=\{d_k \| d_k-d_{k-1}|=0.1,\ k=1, 2 \ldots D\}$, then the pruning scheme produces a smaller subset of detectors $$L_e = \left\{ d_k \,\middle|\, \frac{\partial Y(k)}{\partial k} = 0,\ k = 1, 2 \ldots D \right\}.$$

The points on the excitation pattern are computed for the detectors in $L_e$. The rest of the points in the excitation pattern are computed through linear interpolation.

FIG. 7B shows a reference excitation pattern corresponding with a full computation from the intensity pattern shown in FIG. 7A (as would be done according to the Moore-Glasberg model). Further, FIG. 7B shows a number of pruned detector locations obtained by choosing the locations of maxima and minima on the averaged intensity pattern, and the estimated excitation pattern, which is interpolated from the pruned detector locations. It can be seen that many detectors critical to accurately reproducing the original excitation pattern are not chosen. For the purposes of loudness estimation, the accumulation of errors during integration of specific loudness results in a significant error in the loudness estimate. Accordingly, detector pruning as discussed above may result in inaccurate loudness estimations.

FIG. 8 is a flow diagram illustrating the Moore-Glasberg method including frequency pruning and/or detector pruning to reduce the computational complexity thereof. The flow diagram shown in FIG. 8 is substantially similar to that shown above with respect to FIG. 1, except that in step 204, the determination of the excitation pattern is accomplished using frequency pruning and/or detector pruning. FIG. 9 shows details of step 204 when a frequency pruning approach is used. First, the intensity pattern is determined from the effective power spectrum (step 204A). An average intensity pattern is then determined from the intensity pattern (step 204B). The number of frequency components in the effective power spectrum are then reduced based on the average intensity pattern to obtain a frequency pruned power spectrum (step 204C). Specifically, the maxima of the average intensity pattern are used to identify tonal bands and non-tonal bands, which are then processed as described above to obtain the frequency pruned power spectrum. The excitation pattern is then determined from the frequency pruned power spectrum using a large number of equally spaced detector locations and interpolation (step 204D). Because the effective power spectrum must be processed at each one of the detector locations, reducing the complexity of the effective power spectrum by reducing the number of frequency components therein may reduce the complexity of the calculations for each one of the detector locations. However, due to the large number of detectors used in the conventional Moore-Glasberg approach, the computational complexity may still remain relatively high.

FIG. 10 shows details of step 204 when a detector pruning approach is used. First, the intensity pattern is determined from the effective power spectrum (step 204A). An average intensity pattern is then determined from the intensity pattern (step 204B). A set of pruned detector locations are then determined based on the average intensity pattern (step 204C). Specifically, the minima and maxima of the average intensity pattern define the set of pruned detector locations. The excitation pattern is then determined from the effective power spectrum using each one of the set of pruned detector locations (step 204D). Reducing the number of detector locations significantly reduces the computational complexity of the Moore-Glasberg method. However, such a reduction in complexity comes at the expense of accuracy, which may be severely reduced in some cases.

Accordingly, there is a present need for an auditory analysis technique with reduced complexity and high accuracy.

SUMMARY

The present disclosure relates to methods and systems for efficiently and accurately calculating auditory patterns. In one embodiment, a method includes the steps of calculating a power spectrum from an auditory stimulus, filtering the power spectrum to obtain an effective power spectrum, calculating an intensity pattern from the effective power spectrum, calculating a median intensity pattern from the intensity pattern, determining an initial set of pruned detector locations, examining the initial set of pruned detector locations to determine an enhanced set of pruned detector locations, and calculating an excitation pattern from the effective power spectrum using the enhanced set of pruned detector locations. The power spectrum describes the auditory stimulus in terms of magnitude and frequency. The filtering of the power spectrum is done in a way that approximates a filter response of a human outer and middle ear. The intensity pattern is a total intensity of the effective power spectrum within one effective rectangular bandwidth centered at each one of a number of detector locations within an auditory frequency range. The excitation pattern is a total energy provided by a filter response of each one of a number of detectors each with a center frequency at a different one of the enhanced set of pruned detector locations. By determining the enhanced set of pruned detector locations from the initial set of pruned detector locations and computing the excitation pattern therefrom, the computational complexity of the above method can be significantly reduced when compared to conventional approaches while maintaining a high degree of accuracy. Further, compared to conventional detector pruning approaches, the degree of accuracy of the above method can be significantly improved for a minimal increase in computational complexity.

In one embodiment, examining the initial set of pruned detector locations to determine the enhanced set of pruned detector locations includes determining a difference between a total energy provided by a filter response of a detector with a respective center frequency at each one of a successive pair of detector locations in the initial set of pruned detector locations, and adding an additional detector location between the successive pair of detector locations if the difference is above a predetermined threshold.

In one embodiment, examining the initial set of pruned detector locations to determine the enhanced set of pruned detector locations includes determining a distance between each successive pair of detector locations in the initial set of pruned detector locations and adding an additional detector location between the successive pair of detector locations if the distance is above a predetermined threshold.

In one embodiment, examining the initial set of pruned detector locations to determine the enhanced set of pruned detector locations includes determining a difference between a total energy provided by a filter response of a detector with a respective center frequency at each one of a successive pair of detector locations in the initial set of pruned detector locations, determining a distance between the successive pair of detector locations, and adding an additional detector location between the successive pair of detector locations if the difference and the distance are above respective predetermined thresholds.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the disclosure and illustrate the best mode of practicing the disclosure. Upon reading the following description in light of the accompanying drawings, those skilled in the art will understand the concepts of the disclosure and will recognize applications of these concepts not particularly addressed herein. It should be understood that these concepts and applications fall within the scope of the disclosure and the accompanying claims.

As discussed above, the human auditory system, upon reception of a stimulus, produces neural excitations. These neural excitations are transmitted to the auditory cortex where all higher level inferences pertaining to perception are made. Hence, in auditory patterns based perceptual models, excitation patterns can be viewed as the fundamental features describing a signal, from which perceptual metrics such as loudness can be derived. While conventional loudness estimation models such as the Moore-Glasberg method are capable of providing relatively accurate excitation patterns, they are very computationally expensive. Methods for reducing the computational overhead associated with the Moore-Glasberg method have been explored, however, such methods generally result in a significant reduction in the accuracy of an excitation pattern. As discussed above, an excitation pattern is integrated to obtain an estimate of loudness. Errors in the excitation pattern therefore have a profound effect on the accuracy of the estimated loudness due to accumulation of the errors in the integration.

The excitation of a signal at a detector is computed as the signal energy at that detector. The computation of the excitation pattern is intensive, having a complexity of $\Theta(ND)$ when the FFT length is N and the number of detectors is D. In one embodiment pruning the computations involved in evaluating the excitation pattern can be achieved by explicitly computing only a salient subset of points on the excitation pattern and estimating the rest of the points through interpolation.

Figure 11:
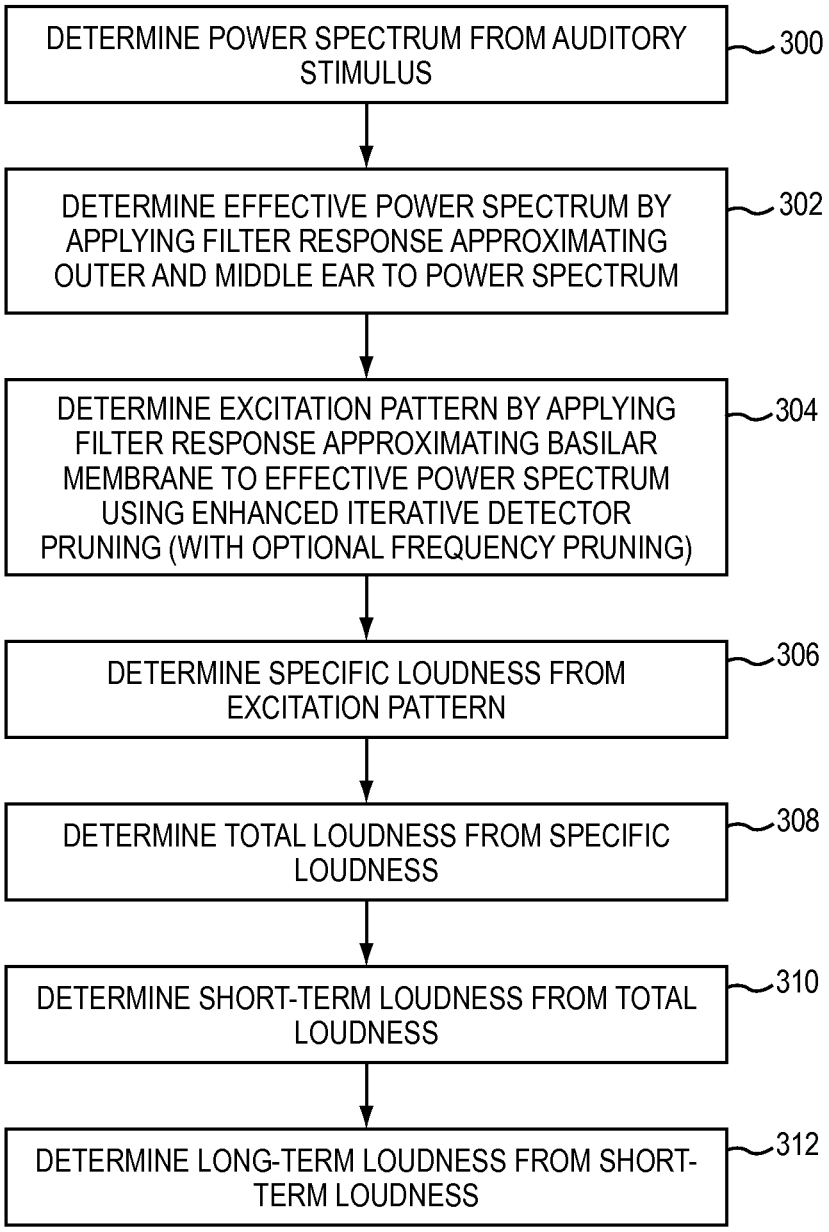
FIG. 11 is a flow diagram illustrating a loudness estimation method according to one embodiment of the present disclosure.

Accordingly, FIG. 11 is a flow diagram illustrating a method for estimating loudness according to one embodiment of the present disclosure. First, a power spectrum of an auditory stimulus (i.e., a sound) is determined (step 300). The power spectrum describes the auditory stimulus in terms of frequency and magnitude. Obtaining the power spectrum may be accomplished by performing a Fourier transform or a fast Fourier transform on the auditory stimulus. Next, an effective power spectrum is determined by applying a filter response representative of the response of the outer and middle ear to the power spectrum (step 302). An excitation pattern is then determined from the effective power spectrum by applying a filter response representative of the response of the basilar membrane of the ear in the cochlea along its length to the effective power spectrum via enhanced iterative detector pruning, the details of which are discussed below (step 304). Specifically, the total energy of the signals produced by detectors at a number of enhanced pruned detector locations comprise the excitation pattern. A specific loudness is then determined from the excitation pattern (step 306), and a total loudness is determined from the specific loudness (step 308). This measure of loudness is also referred to as instantaneous loudness. An averaged measure of the instantaneous loudness, referred to as the short-term loudness, may be determined from the total loudness (step 310). Further, an averaged measure of the short-term loudness, referred to as the long-term loudness, may be determined from the short-term loudness (step 312). While details of steps 300-302 and 306-312 are discussed above, the enhanced iterative detector pruning process is discussed below.

Figure 12:
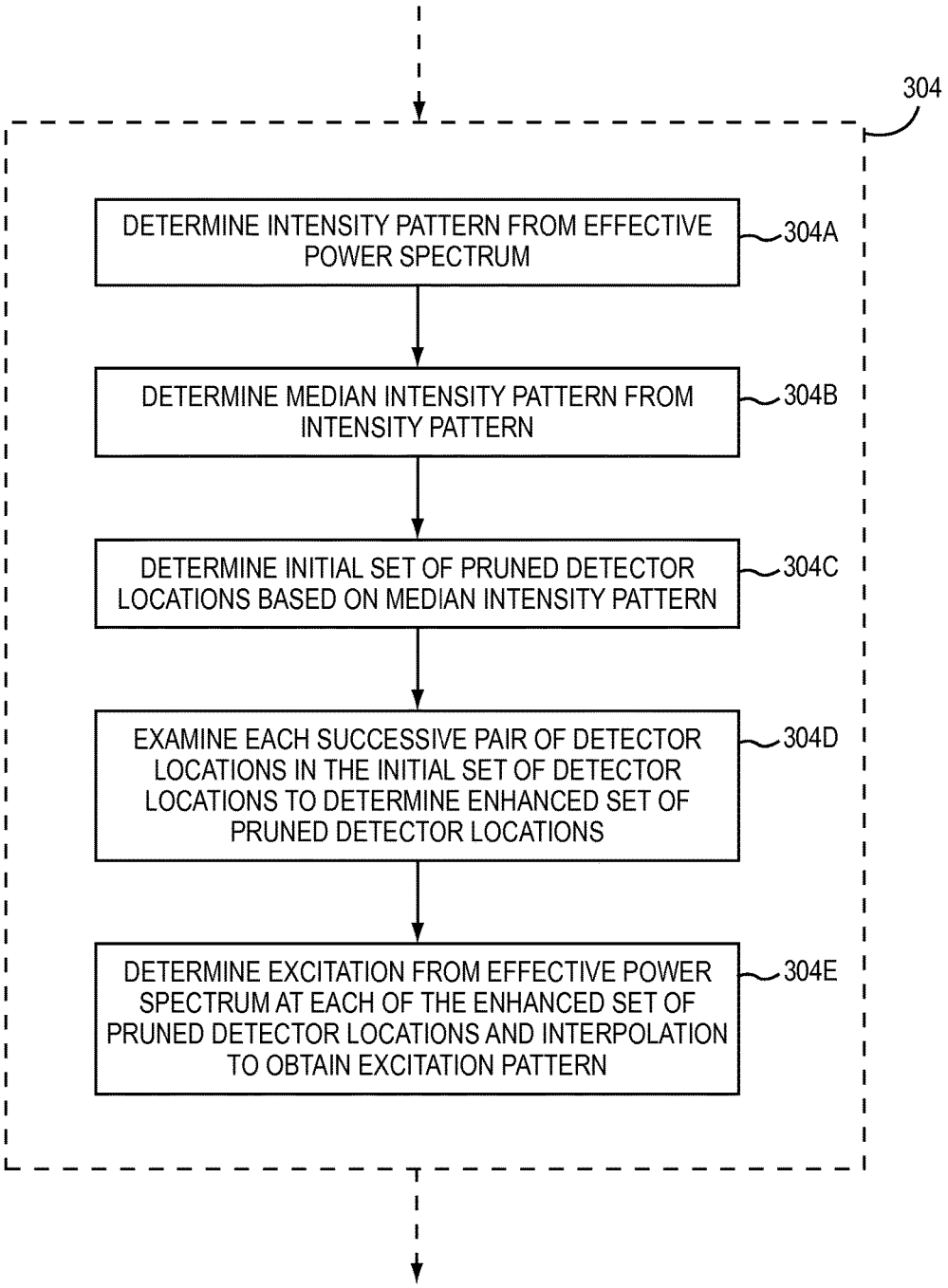
FIG. 12 is a flow diagram illustrating details of the loudness estimation method shown in FIG. 11 according to one embodiment of the present disclosure.

FIG. 12 shows details of step 304 in FIG. 11 according to one embodiment of the present disclosure. First, the intensity pattern is determined from the effective power spectrum (step 304A). A median intensity pattern is then determined from the intensity pattern (step 304B), and an initial set of pruned detector locations is determined from the median intensity pattern (step 304C). Using the median intensity pattern rather than an average intensity pattern to determine the initial set of pruned detector locations may result in the initial set of pruned detector locations better corresponding with salient points of the excitation pattern to be computed, which may increase the accuracy of the loudness estimation as discussed in detail below. Each successive pair of detector locations in the initial set of detector locations is then examined to determine an enhanced set of pruned detector locations (step 304D). This may be an iterative process, as discussed below. Examining each successive pair of detector locations in the initial set of detector locations to determine the enhanced set of pruned detector locations greatly improves the accuracy of the loudness estimation with a minimal increase in the computational complexity thereof, as discussed in detail below. The excitation pattern is then determined from the effective power spectrum using each one of the enhanced set of pruned detector locations and interpolation (step 304E).

Figure 13:
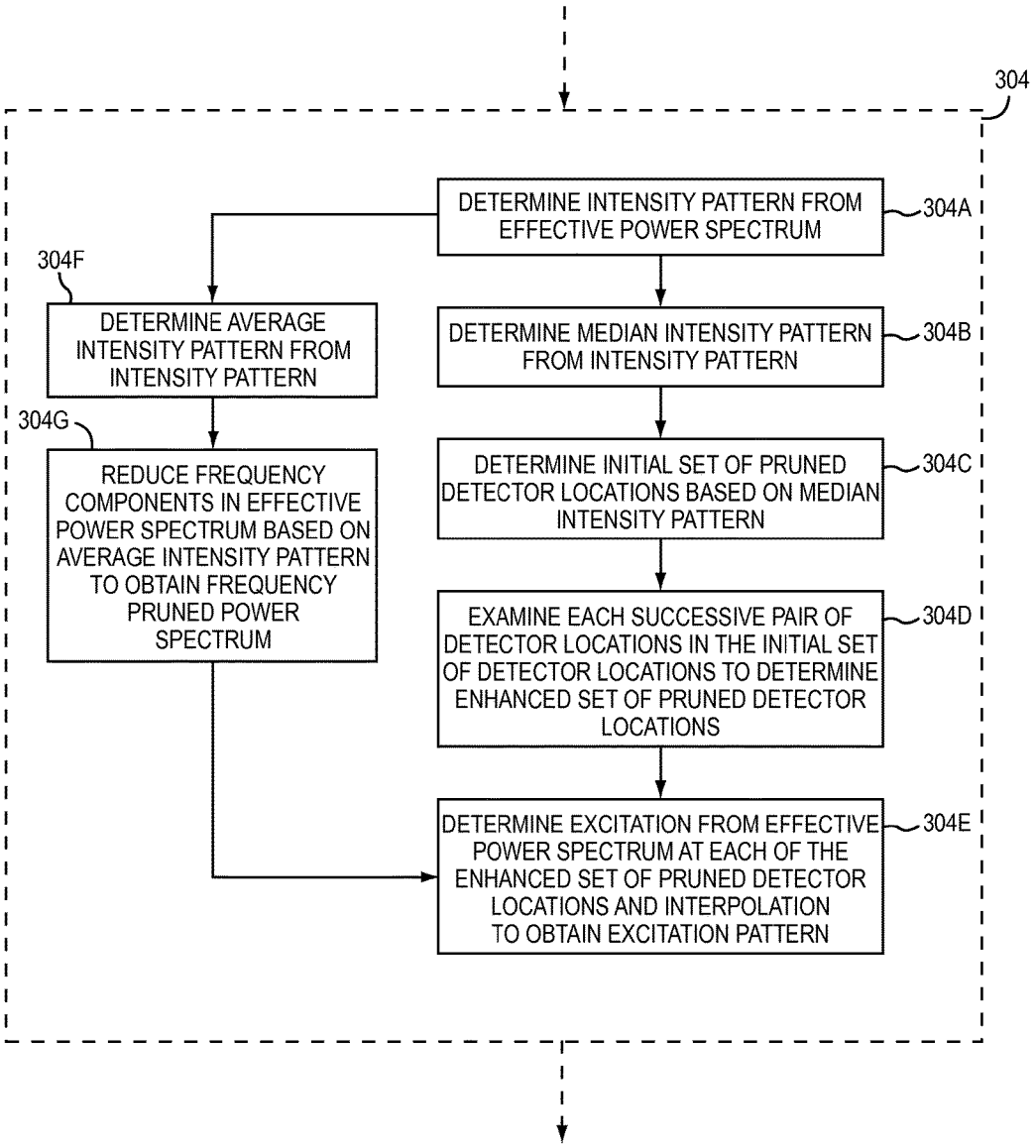
FIG. 13 is a flow diagram illustrating details of the loudness estimation method shown in FIG. 11 according to an additional embodiment of the present disclosure.

In one embodiment, frequency pruning is used in addition to the enhanced iterative detector pruning process discussed above. Accordingly, FIG. 13 is a flow diagram illustrating details of step 304 according to an additional embodiment of the present disclosure. FIG. 13 is substantially similar to FIG. 12 shown above, with steps 304A through 304E being the same as above. However, steps 304F and 304G are added. In addition to the median intensity pattern, an average intensity pattern is also calculated from the intensity pattern (step 304F). The number of frequency components in the effective power spectrum are then reduced based on the average intensity pattern (step 304G) as discussed above. Using frequency pruning in addition to the enhanced iterative detector pruning may provide additional reductions in the computational complexity of the loudness estimation.

Figure 14:
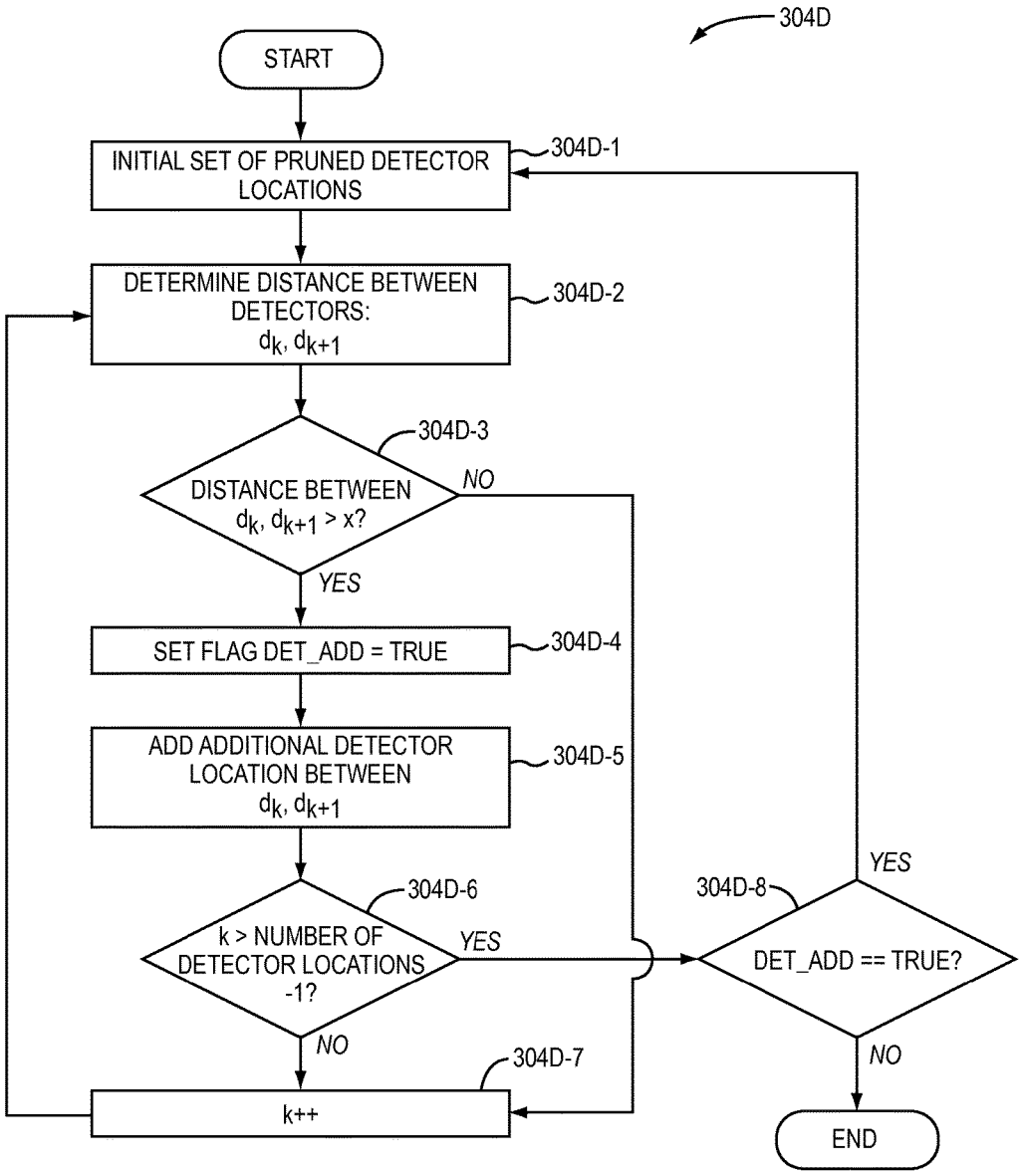
FIG. 14 is a flow diagram illustrating further details of the loudness estimation method shown in FIGS. 12 and 13 according to one embodiment of the present disclosure.

FIG. 14 is a flow diagram illustrating details of step 304D discussed above according to one embodiment of the present disclosure. The process starts with the initial set of pruned detector locations (step 304D-1). A distance is obtained between a first detector location $d_k$ and a second successive detector location $d_{k+1}$ in the initial set of pruned detector locations (step 304D-2). The distance between the first detector location $d_k$ and the second detector location $d_{k+1}$ is then compared to a predetermined threshold x (step 304D-3). As discussed herein, the distance between detector locations is the amount of frequency spectrum between the detector locations. If the distance between the first detector location $d_k$ and the second detector location $d_{k+1}$ is above the predetermined threshold x, a flag DET_ADD is set (step 304D-4), and an additional detector location is added between the first detector location $d_k$ and the second detector location $d_{k+1}$ (step 304D-5). A determination is then made whether the second detector location $d_{(k+1)}$ is the last detector location in the initial set of pruned detector locations (step 304D-6). If the second detector location $d_{k+1}$ is not the last detector location in the initial set of pruned detector locations, the second detector location $d_{k+1}$ becomes the first detector location $d_k$ and the second detector location $d_{k+1}$ is replaced with the successive detector location (step 304D-7). If the distance between the first detector location $d_k$ and the second detector location $d_{k+1}$ is determined as not greater than the predetermined threshold in step 304D-3, an additional detector location is not added, and the process moves on to the next pair of successive detector locations as discussed above in step 304D-7. If the second detector location $d_{k+1}$ is the last detector location in the initial set of detector locations, a determination is made if the DET_ADD flag was set (step 304D-8). As discussed above, the DET_ADD flag indicates that an additional detector location was added to the initial set of detector locations. If this flag was set, it may indicate that further iteration is required to make sure that further detector locations are not required. Accordingly, if the DET_ADD flag was set, the process may repeat starting at step 304D-1 with the updated initial set of pruned detector locations. If the DET_ADD flag was not set, the process may end.

Figure 15:
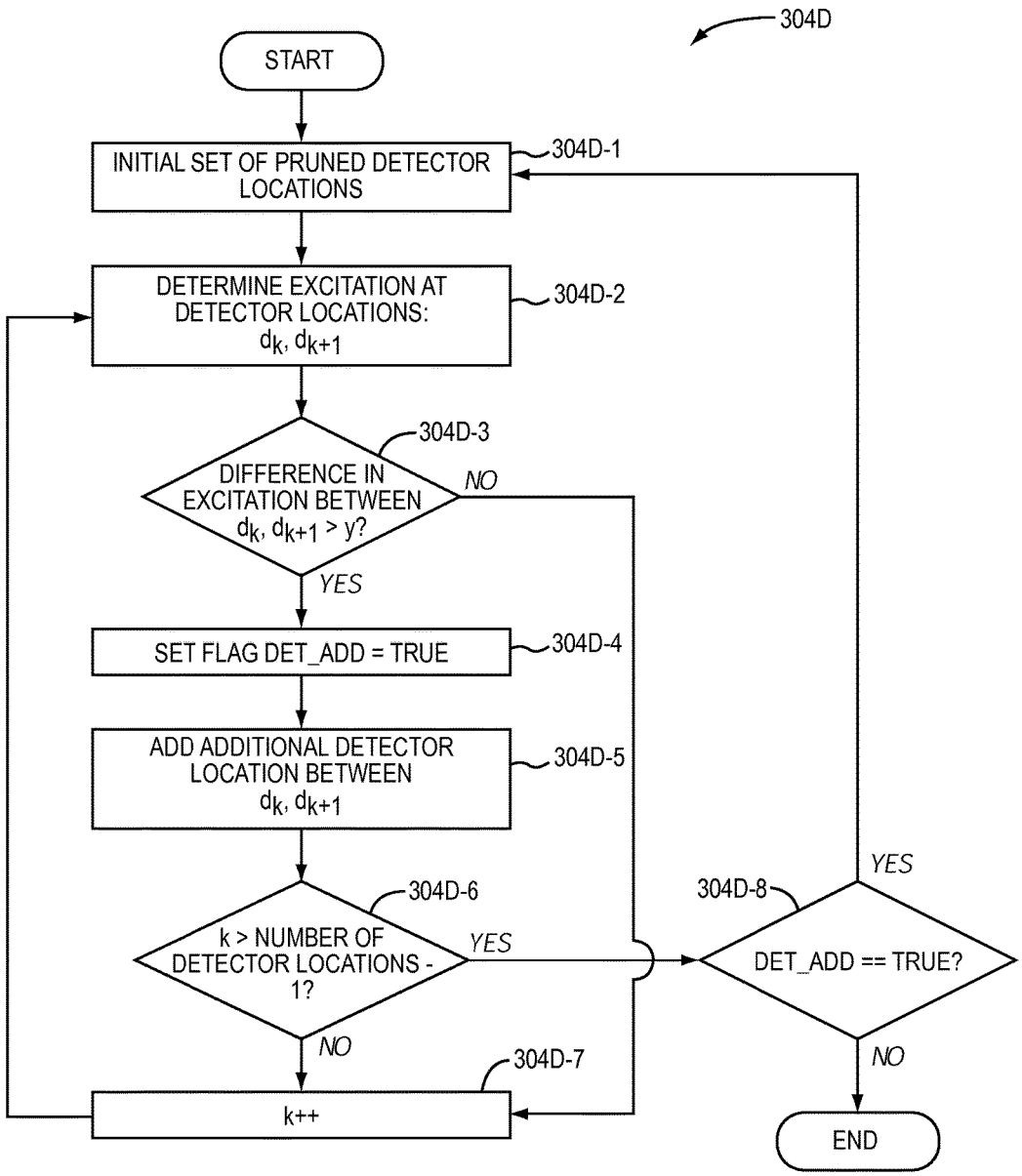
FIG. 15 is a flow diagram illustrating further details of the loudness estimation method shown in FIGS. 12 and 13 according to an additional embodiment of the present disclosure.

FIG. 15 is a flow diagram illustrating additional details of step 304D discussed above according to an additional embodiment of the present disclosure. The process starts with the initial set of pruned detector locations (step 304D-1). An excitation is determined at a first detector location $d_k$ and a second successive detector location $d_{k+1}$ in the initial set of pruned detector locations (step 304D-2). The difference in the excitation values for the first detector location $d_k$ and the second detector location $d_{k+1}$ is then compared to a predetermined threshold y (step 304D-3). If the difference in excitation between the first detector location $d_k$ and the second detector location $d_{k+1}$ is above the predetermined threshold y, a flag DET_ADD is set (step 304D-4), and an additional detector location is added between the first detector location $d_k$ and the second detector location $d_{k+1}$ (step 304D-5). A determination is then made whether the second detector location $d_{(k+1)}$ is the last detector location in the initial set of pruned detector locations (step 304D-6). If the second detector location $d_{k+1}$ is not the last detector location in the initial set of pruned detector locations, the second detector location $d_{k+1}$ becomes the first detector location $d_k$ and the second detector location $d_{k+1}$ is replaced with the successive detector location (step 304D-7). If the difference in excitation between the first detector location $d_k$ and the second detector location $d_{k+1}$ is determined as not greater than the predetermined threshold in step 304D-3, an additional detector location is not added, and the process moves on to the next pair of successive detector locations as discussed above in step 304D-7. If the second detector location $d_{k+1}$ is the last detector location in the initial set of detector locations, a determination is made if the DET_ADD flag was set (step 304D-8). As discussed above, the DET_ADD flag indicates that an additional detector location was added to the initial set of detector locations. If this flag was set, it may indicate that further iteration is required to make sure that further detector locations are not required. Accordingly, if the DET_ADD flag was set, the process may repeat starting at step 304D-1 with the updated initial set of pruned detector locations. If the DET_ADD flag was not set, the process may end.

Figure 16:
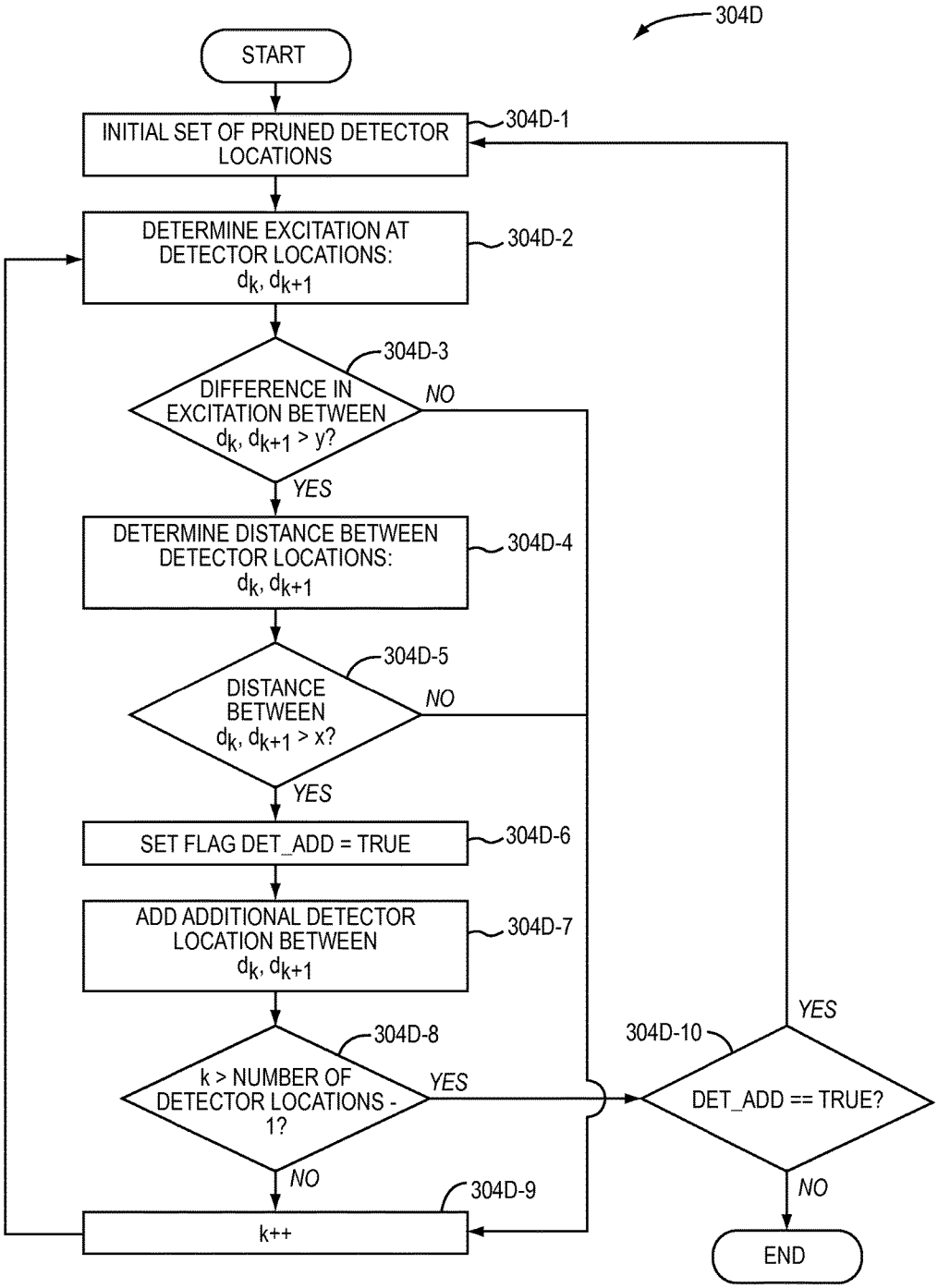
FIG. 16 is a flow diagram illustrating further details of the loudness estimation method shown in FIGS. 12 and 13 according to an additional embodiment of the present disclosure.

FIG. 16 is a flow diagram illustrating additional details of step 304D discussed above according to an additional embodiment of the present disclosure. The process starts with the initial set of pruned detector locations (step 304D-1). An excitation is determined at a first detector location $d_k$ and a second successive detector location $d_{k+1}$ in the initial set of pruned detector locations (step 304D-2). The difference in the excitation values for the first detector location $d_k$ and the second detector location $d_{k+1}$ is then compared to a predetermined threshold y (step 304D-3). If the difference in excitation between the first detector location $d_k$ and the second detector location $d_{k+1}$ is above the predetermined threshold y, a distance between the first detector location $d_k$ and the second detector location $d_{k+1}$ is determined (step 304D-4). If the distance between the first detector location $d_k$ and the second detector location $d_{k+1}$ is above a predetermined threshold x (step 304D-5), a flag DET_ADD is set (step 304D-6), and an additional detector location is added between the first detector location $d_k$ and the second detector location $d_{k+1}$ (step 304D-7). A determination is then made whether the second detector location $d_{(k+1)}$ is the last detector location in the initial set of pruned detector locations (step 304D-8). If the second detector location $d_{k+1}$ is not the last detector location in the initial set of pruned detector locations, the second detector location $d_{k+1}$ becomes the first detector location $d_k$ and the second detector location $d_{k+1}$ is replaced with the successive detector location (step 304D-9). If the difference in excitation between the first detector location $d_k$ and the second detector location $d_{k+1}$ is determined as not greater than the predetermined threshold in step 304D-3, or the distance between the first detector location $d_k$ and the second detector location $d_{k+1}$ is determined as not greater than the predetermined threshold in step 304D-5, an additional detector location is not added, and the process moves on to the next pair of successive detector locations as discussed above in step 304D-9. If the second detector location $d_{k+1}$ is the last detector location in the initial set of detector locations, a determination is made if the DET_ADD flag was set (step 304D-10). As discussed above, the DET_ADD flag indicates that an additional detector location was added to the initial set of detector locations. If this flag was set, it may indicate that further iteration is required to make sure that further detector locations are not required. Accordingly, if the DET_ADD flag was set, the process may repeat starting at step 304D-1 with the updated initial set of pruned detector locations. If the DET_ADD flag was not set, the process may end.

Figure 17:
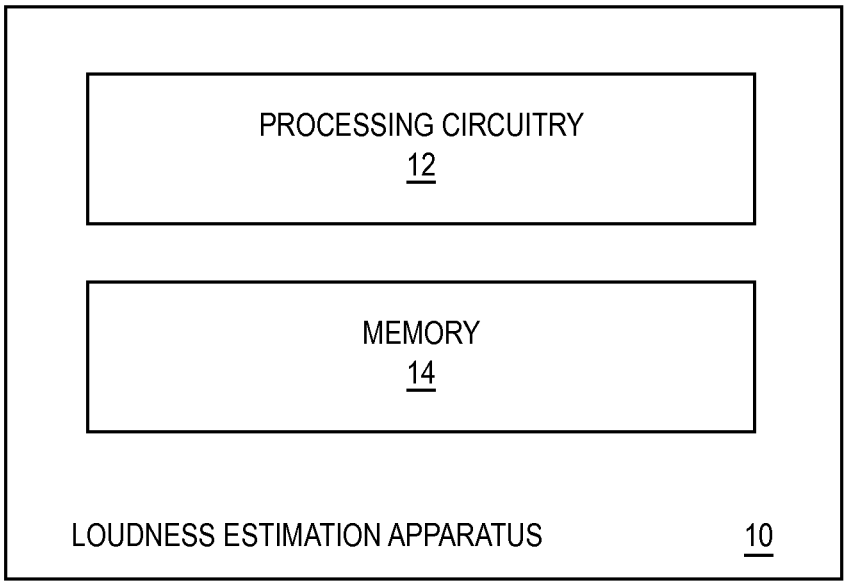
FIG. 17 is a block diagram illustrating a loudness estimation apparatus according to one embodiment of the present disclosure.

FIG. 17 is a block diagram illustrating a loudness estimation apparatus 10 according to one embodiment of the present disclosure. The loudness estimation apparatus may include processing circuitry 12 and a memory 14. The memory 14 may store instructions, which, when executed by the processing circuitry 12 cause the loudness estimation apparatus 10 to carry out any of the steps discussed above in order to estimate the loudness of an auditory stimulus.

Figure 1:
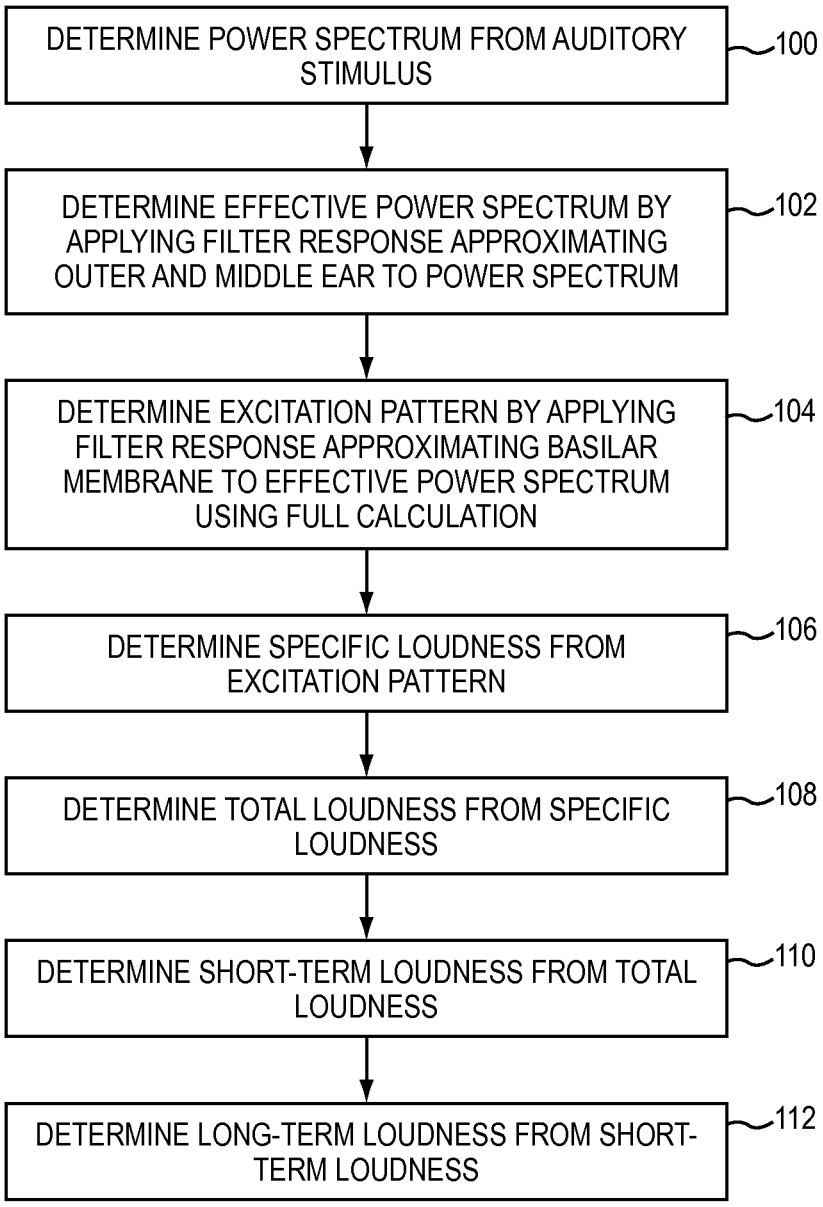
FIG. 1 (RELATED ART)
FIG. 1 is a flow diagram illustrating a conventional loudness estimation method.
Figure 2:
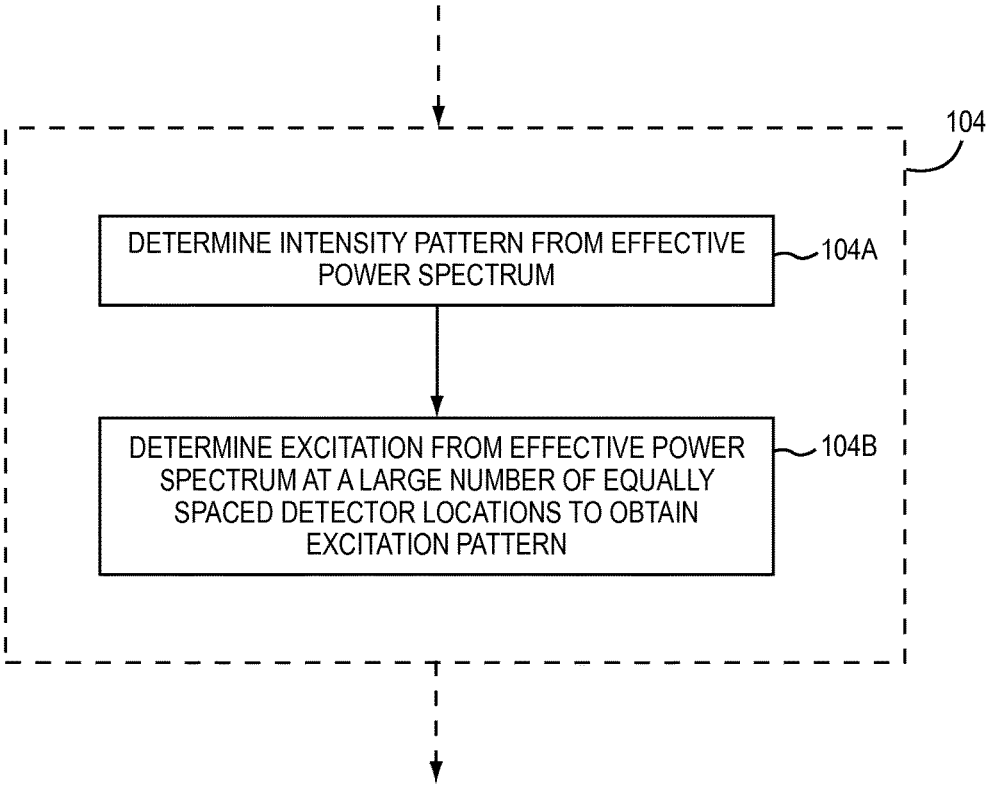
FIG. 2 (RELATED ART)
FIG. 2 is a flow diagram illustrating details of the conventional loudness estimation method shown in FIG. 1.
Figure 3:
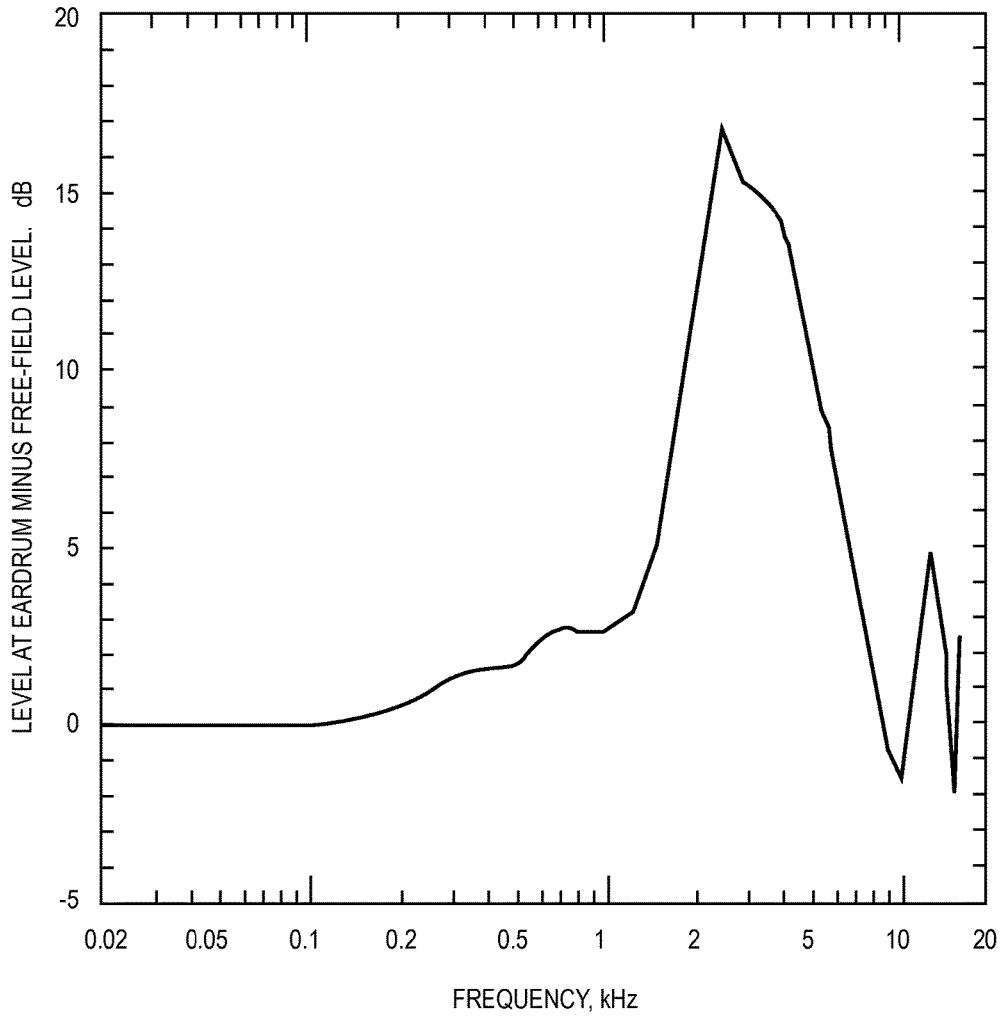
FIG. 3 (RELATED ART)
FIG. 3 is a graph illustrating a filter response of a human outer ear.
Figure 4:
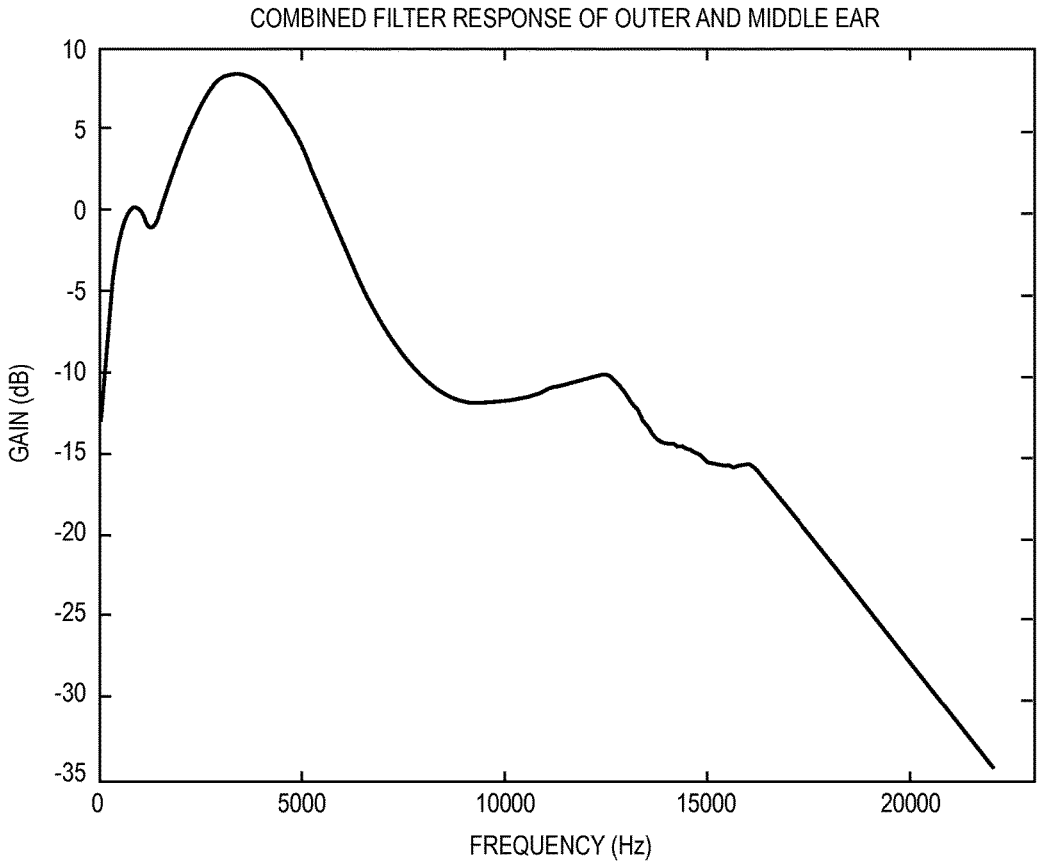
FIG. 4 (RELATED ART)
FIG. 4 is a graph illustrating a filter response of a human outer and middle ear.
Figure 5A:
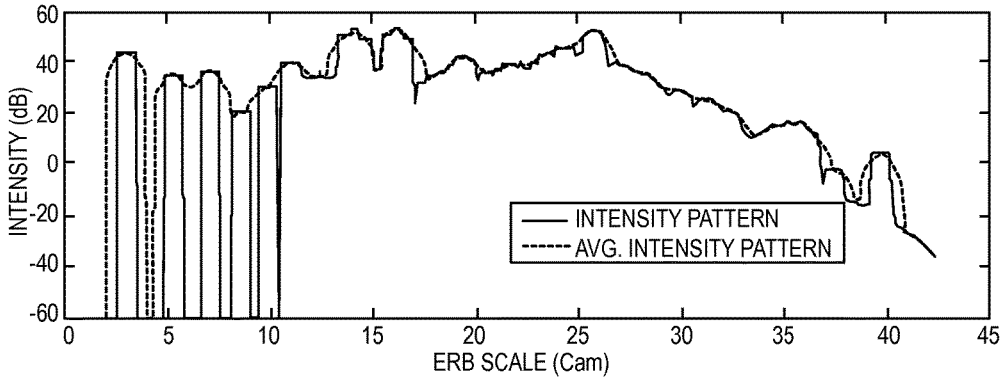
FIG. 5A (RELATED ART)
FIGS. 5A and 5B are graphs illustrating a conventional frequency pruning process.
Figure 5B:
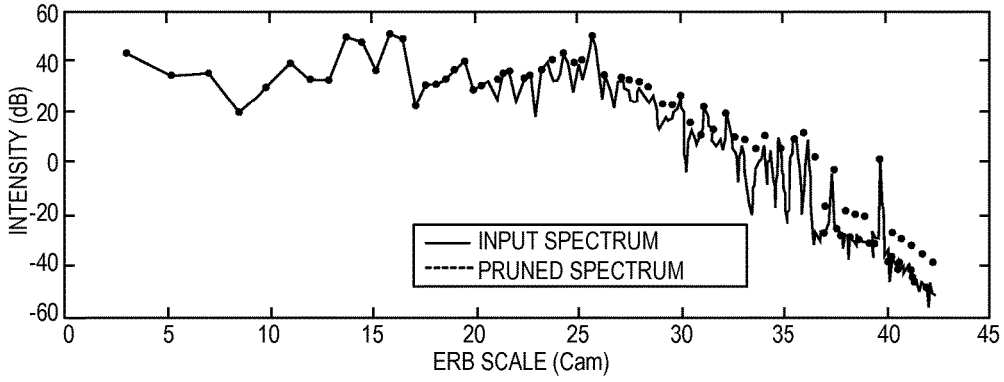
FIG. 5B (RELATED ART)
Figure 6A:
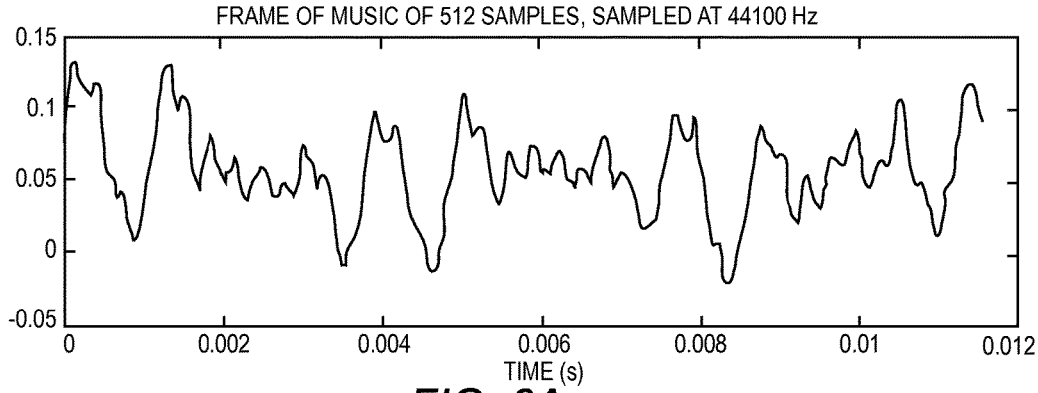
FIG. 6A (RELATED ART)
FIGS. 6A through 6C illustrate the conventional loudness estimation method in FIG. 1.
Figure 6B:
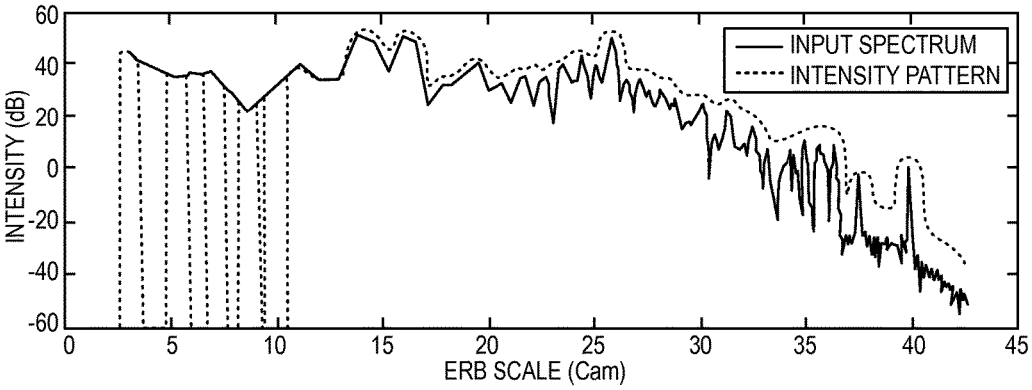
FIG. 6B (RELATED ART)
Figure 6C:
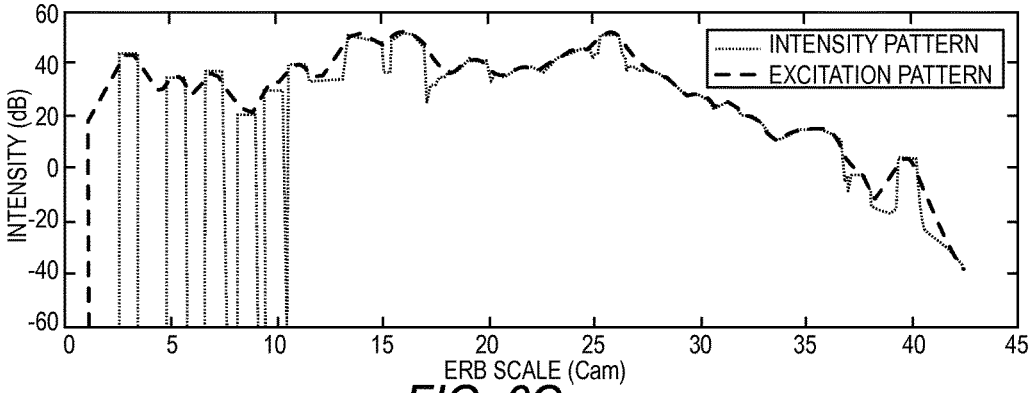
FIG. 6C (RELATED ART)

The excitation at a detector location strongly depends on the energy of $S_x^c(\omega)$ within the bandwidth (i.e., the ERB) of the detector. It is higher when the magnitudes of frequency components of the signal in the ERB are higher. This can be observed in FIG. 6C, where rises and falls in the excitation pattern closely follow those of the intensity pattern. Moreover, it is observable that sharp transitions in the intensity pattern correspond to steep transitions in the excitation pattern. Detector locations at these transitions must also be chosen to accurately capture the shape of the excitation pattern.

Figure 18:
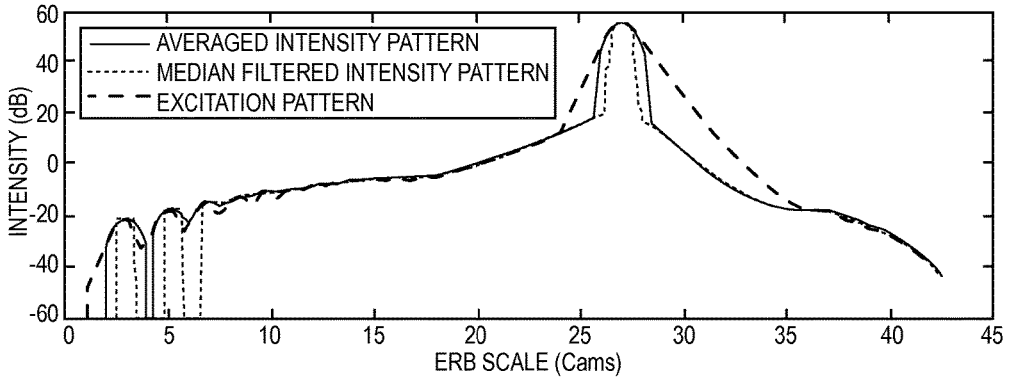
FIG. 18 is a graph illustrating one or more aspects of the loudness estimation method shown in FIG. 11 according to one embodiment of the present disclosure.

To ensure retention of sharp transitions in the intensity pattern and yet effectively smoothen the pattern, median filtering is more effective than averaging. This is illustrated in FIG. 18. As shown, the median filtered intensity pattern Z(k) better captures the sharp rises and falls in the intensity pattern, as shown in Equation (23):

$$Z(k)=\text{median}(\{I(k-2)I(k-1)I(k)I(k+1)I(k+2)\}) \tag{23}$$

This is particularly useful when there are strong tonal components in the signal, such as sinusoids and music from single instruments. When the intensity pattern does not have sharp discontinuities, the filtered patterns are smoother and closely follow the excitation pattern. Accordingly, in one embodiment of the present disclosure, a median filtered intensity pattern is used to determine an initial set of detector locations.

In order to capture salient points in addition to the maxima and minima of the averaged intensity pattern Y(k), the following method is adopted. The initial pruned set is chosen to be $$L_e = \left\{ d_k \;\middle|\; \frac{\partial Y(k)}{\partial k} = 0 \text{ or } \frac{\partial Z(k)}{\partial k} = 0, k = 1, 2 \ldots D \right\}$$

and the pruned excitation pattern sequence $E_e$ is computed. If the first difference of the excitations is high in any location with a large separation (i.e., above a predetermined threshold) of pruned detectors at that location, then, more detectors are chosen in between these two detectors, as illustrated by Equation (24):

$$E_e=\{(d_k,E(k))|d_k\in L_e,k=1,2, \ldots D\} \tag{24}$$

For any two consecutive pairs $(d_m,E(m))$ and $(d_{m+n},E(m+n+1))\in E_e$, if $|E(m+n+1)-E(m)|>E_{thresh}$ and $|d_{m+n+1}-d_m|>d_{thresh}$, then the detectors $\{d_k|k=m+P, m+2P, \ldots, k<m+n+1\}$ are chosen and $L_e$ is reassigned as shown in Equation (28). The value of P may be chosen to be 25 in some embodiments. $E_{thresh}$ may be chosen as 30 dB and $d_{thresh}$ as 5.0. $Z_{thresh}$ may be chosen as 10. Equation (25) shows the enhanced updated set of pruned detectors:

$$L_e = \left\{ d_k \;\middle|\; \frac{\partial Y(k)}{\partial k} = 0 \; or \; \frac{\partial Z(k)}{\partial k} > Z_{thresh}, k = 1, 2 \ldots D \right\} \cup \{d_k \mid k = m + P, m + 2P, \ldots, k < m + n + 1\} \tag{25}$$

Figure 7A:
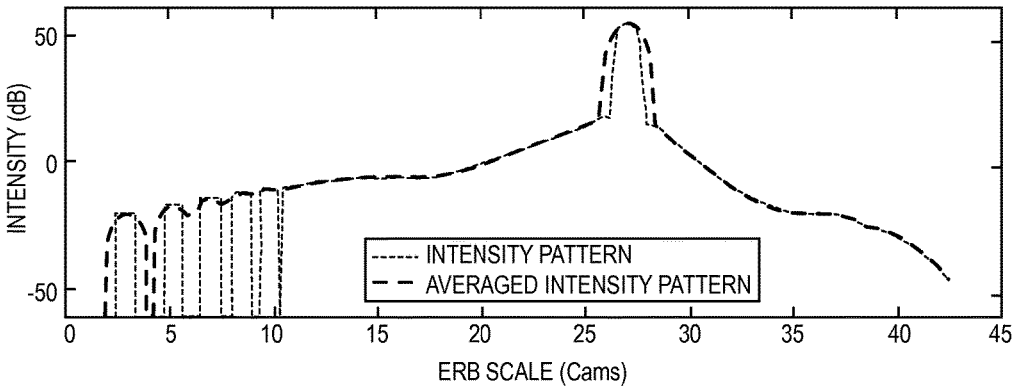
FIG. 7A (RELATED ART)
FIGS. 7A and 7B are graphs illustrating a conventional detector pruning process.
Figure 7B:
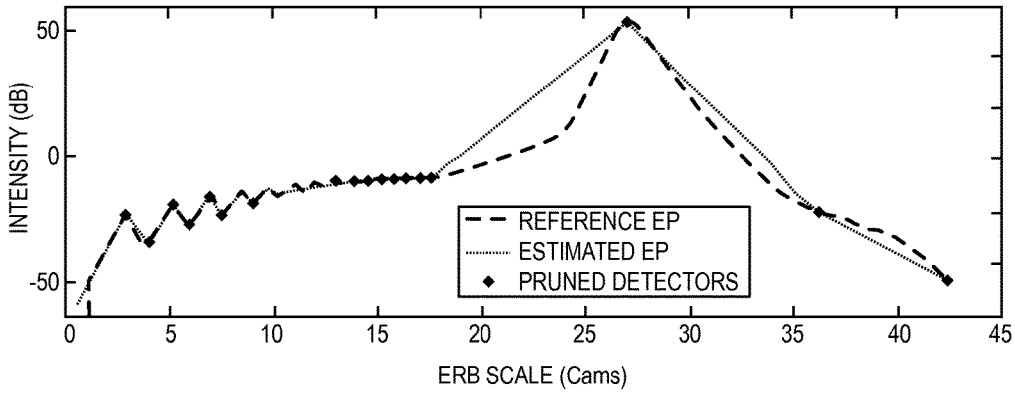
FIG. 7B (RELATED ART)
Figure 8:
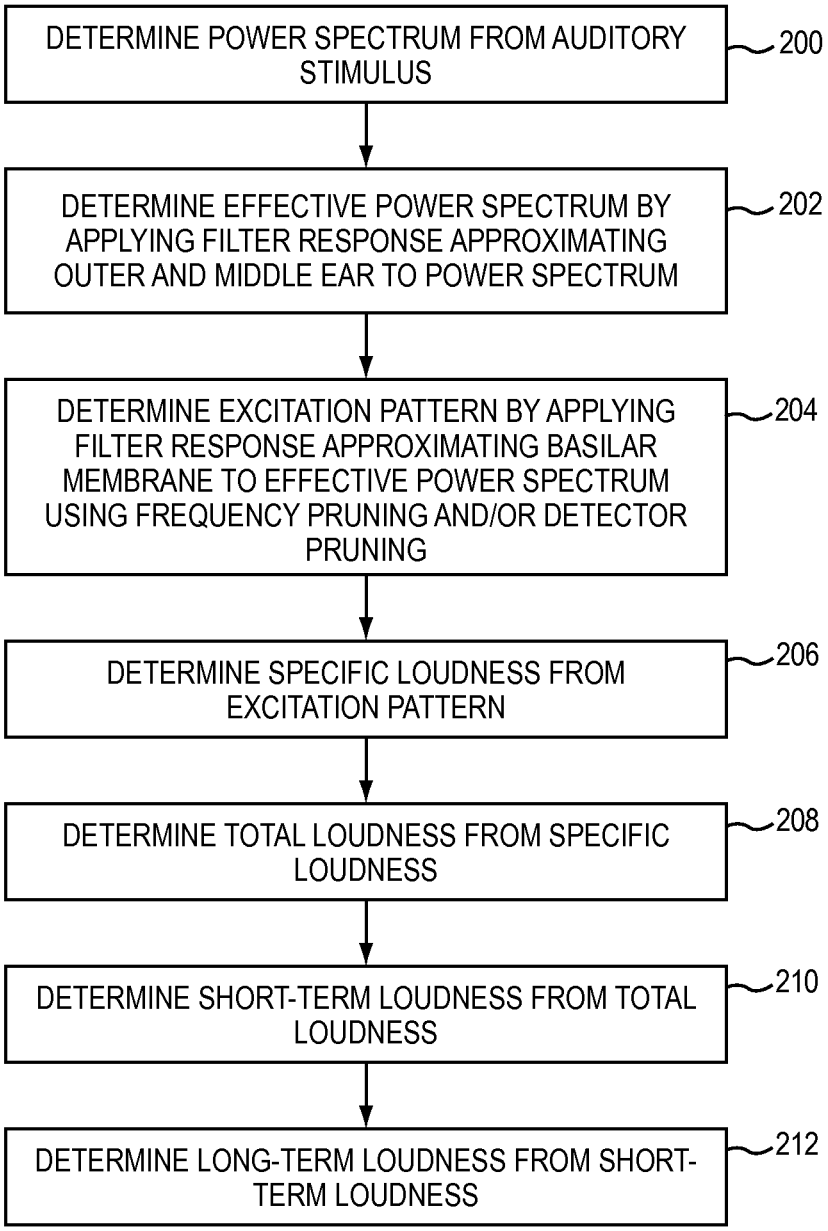
FIG. 8 is a flow diagram illustrating a conventional loudness estimation method including frequency pruning and/or detector pruning.
Figure 9:
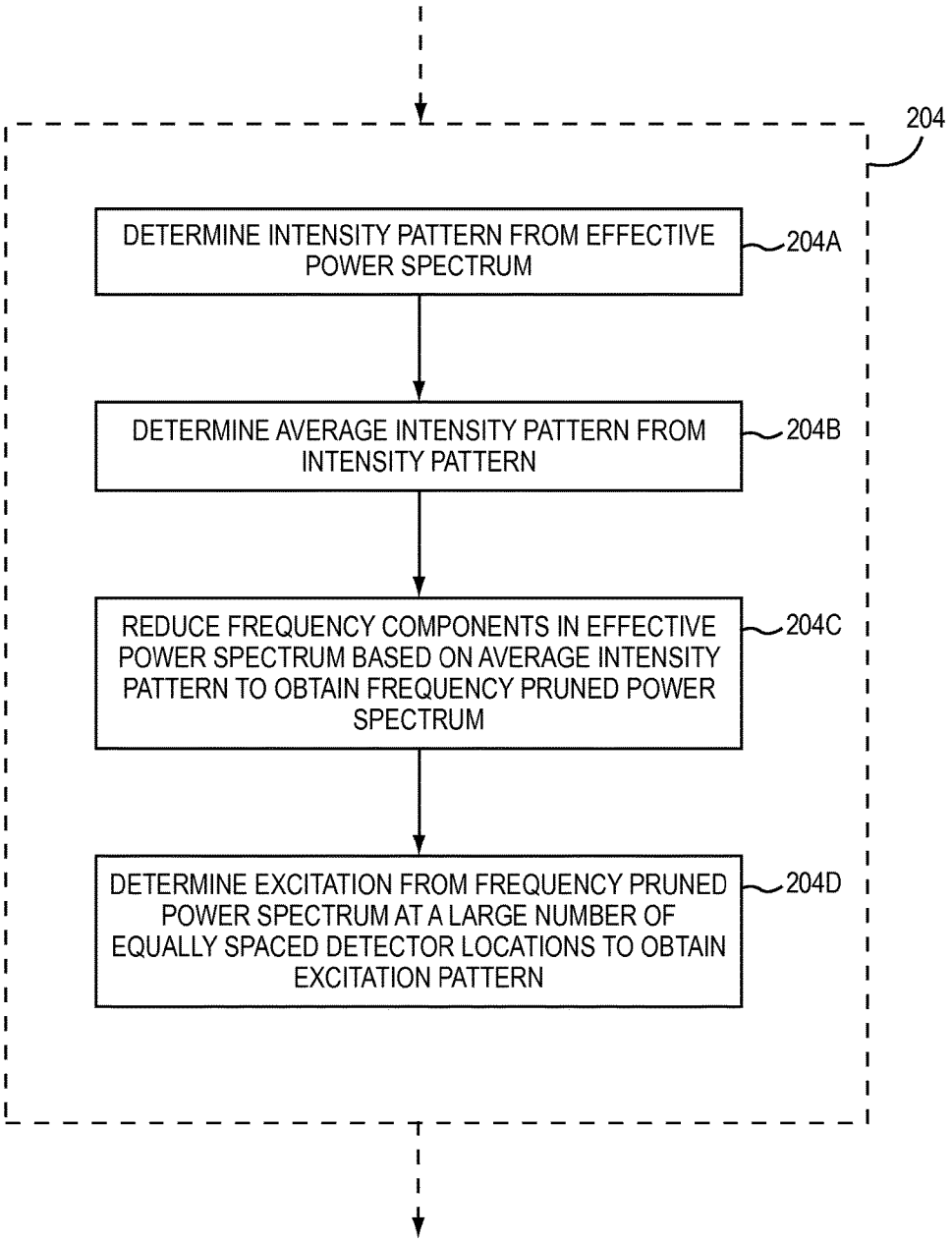
FIG. 9 is a flow diagram illustrating details of the conventional loudness estimation method shown in FIG. 8.
Figure 10:
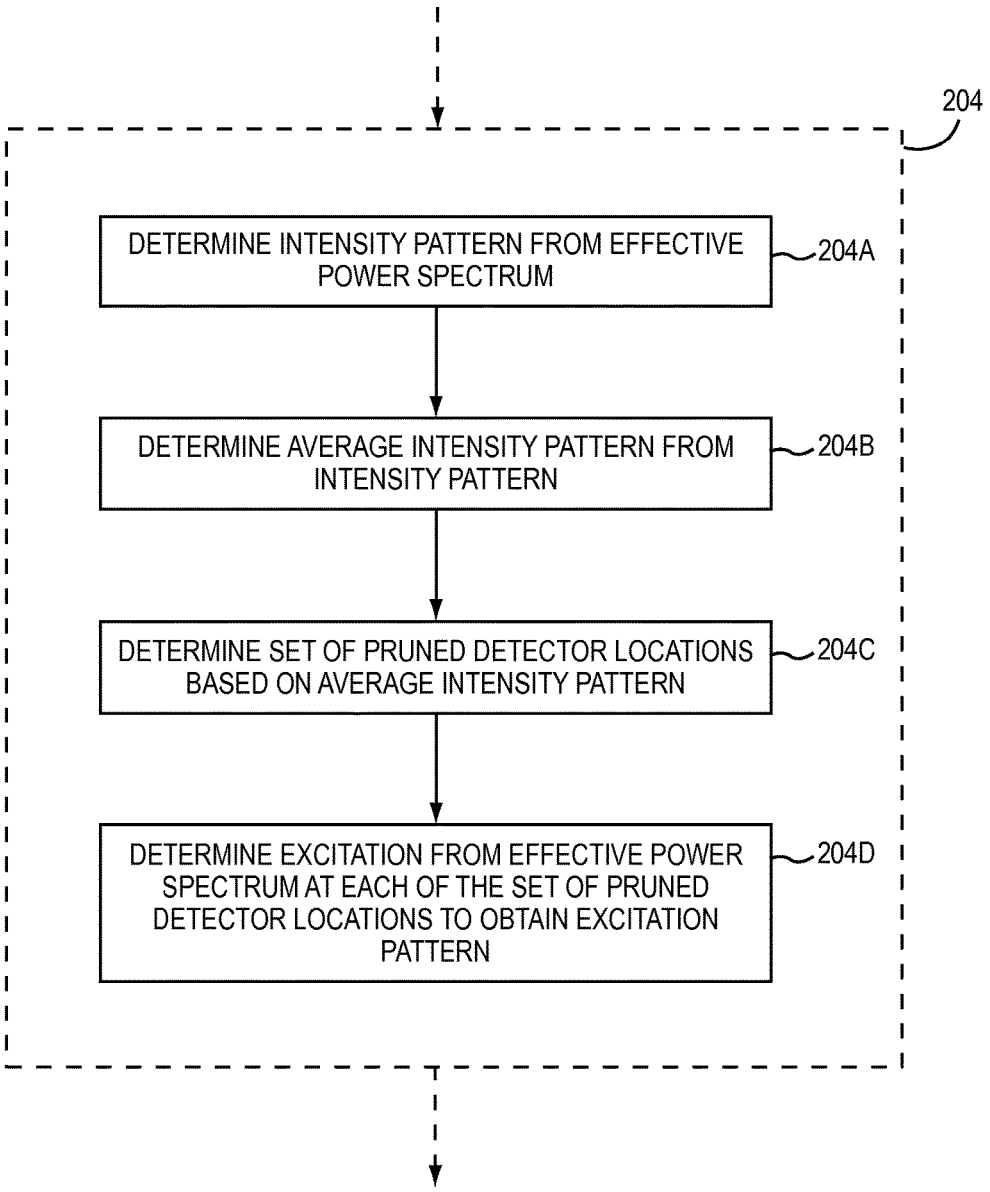
FIG. 10 is a flow diagram illustrating details of the conventional loudness estimation method shown in FIG. 8.
Figure 19:
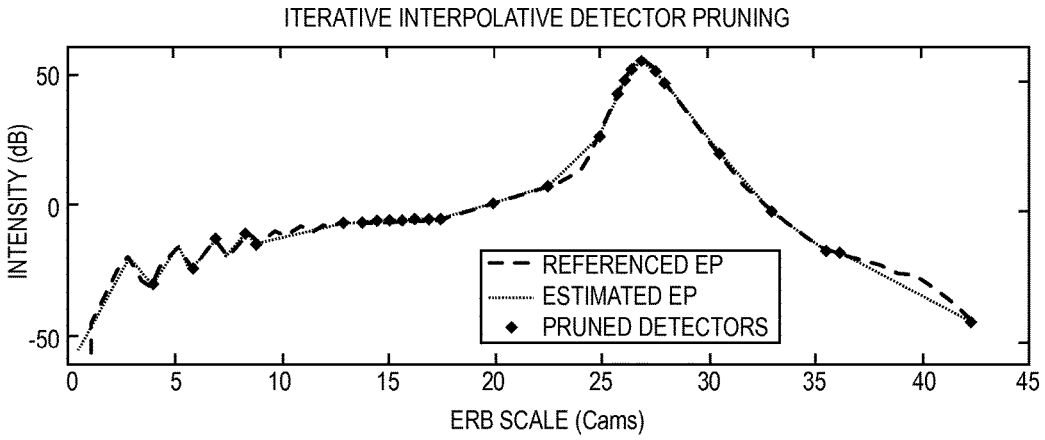
FIG. 19 is a graph illustrating one or more aspects of the loudness estimation method shown in FIG. 11 according to one embodiment of the present disclosure.

An example is shown in FIG. 19, which shows an excitation pattern computed using the enhanced iterative pruning method discussed above. For comparison, an excitation pattern calculated using conventional detector pruning is shown in FIG. 7B above. It can be seen from the Figures that the enhanced iterative detector pruning produces an estimate of the excitation pattern which better resembles the reference pattern when compared to that of conventional detector pruning. That is, the enhanced iterative detector pruning described herein results in significant improvements in the accuracy of loudness estimation for a minimal increase in complexity. Capturing the additional detectors is useful at sharp roll-offs in the excitation pattern. Such patterns can be commonly produced by tonal and synthetic sounds.

The auditory filters, as already discussed, are frequency selective bandpass filters. Hence, by exploiting their limited regions of support, huge computational savings can be achieved. The region of support is small for the lower detector locations and gradually rises for detectors at higher center frequencies. Hence, choosing more detectors at lower center frequencies does not add significant computational complexity as opposed to choosing detectors at higher center frequencies. Accordingly, the predetermined threshold used to determine when an additional detector location should be added between two successive detector locations may be adjusted based on the particular detector locations. In other words, the predetermined threshold may be adjusted such that it is more likely that additional detector locations will be located at lower frequencies, while avoiding additional detector locations at higher frequencies in order to further reduce computational complexity.

Figure 20A:
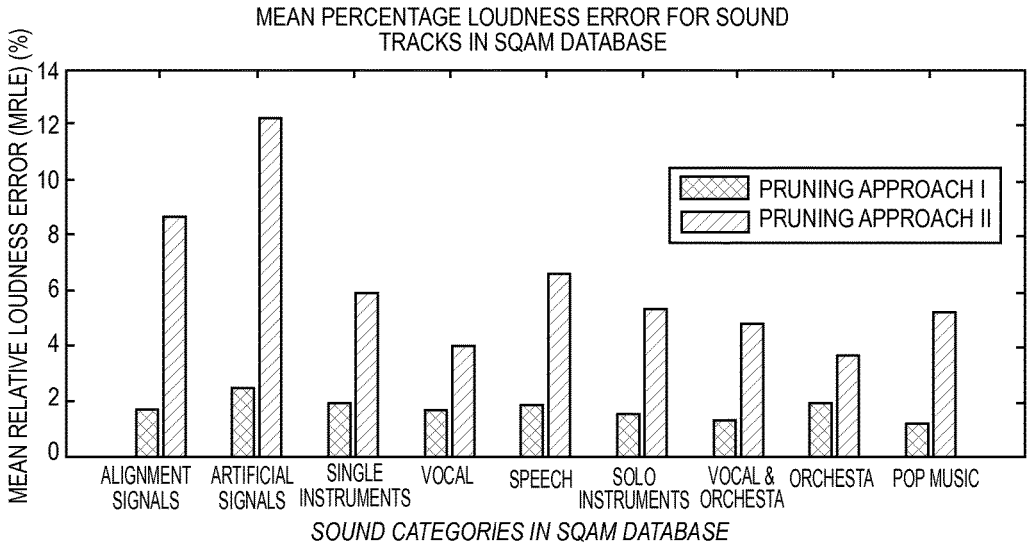
FIG. 20 is a graph illustrating the performance improvements associated with the loudness estimation method according to one embodiment of the present disclosure.
Figure 20B:
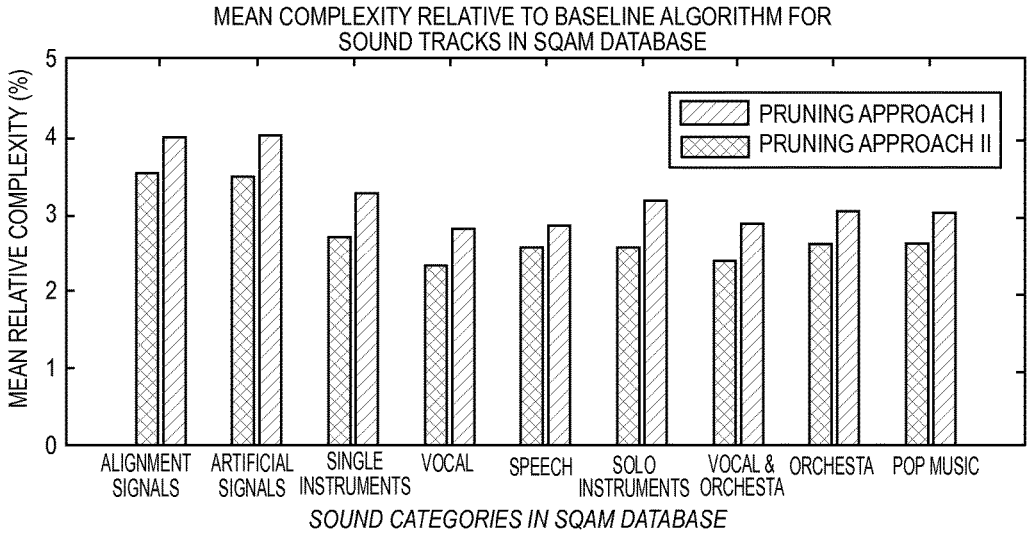

The enhanced iterative detector pruning described above significantly improves the accuracy of loudness estimation with a minimal increase in computational complexity compared to conventional detector pruning approaches. Accordingly, FIG. 20A illustrates the mean relative loudness error (MRLE) associated with the enhanced iterative detector pruning approach (labeled "pruning approach I") and a conventional detector pruning approach as described in the background (labeled "pruning approach II"). As shown, the MRLE, which is a measure of the accuracy of loudness estimation of the method, is significantly better for the enhanced iterative detector pruning approach. Further, FIG. 20B shows that the enhanced iterative detector pruning approach results in only a small increase in the mean relative complexity (a measure of the computational complexity) thereof compared to the conventional detector pruning approach.

Those skilled in the art will recognize improvements and modifications to the embodiments of the present disclosure. All such improvements and modifications are considered within the scope of the concepts disclosed herein and the claims that follow.

What is claimed is:

1. A method for providing loudness estimation from an auditory stimulus, comprising:

calculating a power spectrum from the auditory stimulus such that the power spectrum describes the auditory stimulus in terms of magnitude and frequency;

filtering the power spectrum in a way that approximates a filter response of a human outer and middle ear to obtain an effective power spectrum;

calculating an intensity pattern from the effective power spectrum, the intensity pattern comprising a total intensity of the effective power spectrum within one effective rectangular bandwidth centered at each one of a plurality of detector locations within an auditory frequency range;

calculating a median intensity pattern from the intensity pattern;

determining an initial set of pruned detector locations within the auditory frequency range based on the median intensity pattern;

examining each successive pair of detector locations in the initial set of pruned detector locations to determine an enhanced set of pruned detector locations within the auditory frequency range; and calculating an excitation pattern from the effective power spectrum, the excitation pattern comprising a total energy provided by a filter response of each one of a plurality of detectors with a respective center frequency at a different one of the enhanced set of pruned detector locations.

2. The method of claim 1 wherein examining each successive pair of detector locations in the initial set of pruned detector locations to determine the enhanced set of pruned detector locations comprises:

determining a difference between the total energy provided by the filter response of a detector with a respective center frequency at each successive pair of detector locations; and if the difference is above a predetermined threshold, adding an additional detector location between the successive pair of detector locations.

3. The method of claim 2 wherein examining each successive pair of detector locations in the initial set of pruned detector locations to determine the enhanced set of pruned detector locations is performed iteratively.

4. The method of claim 2 wherein the predetermined threshold changes based on the location of each one of the successive pair of detector locations.

5. The method of claim 1 wherein examining each successive pair of detector locations in the initial set of pruned detector locations to determine the enhanced set of pruned detector locations comprises:

determining a distance between each successive pair of detector locations; and if the distance is above a predetermined threshold, adding an additional detector location between the successive pair of detector locations.

6. The method of claim 5 wherein examining each successive pair of detector locations in the initial set of pruned detector locations to determine the enhanced set of pruned detector locations is performed iteratively.

7. The method of claim 1 wherein examining each successive pair of detector locations in the initial set of pruned detector locations to determine the enhanced set of pruned detector locations comprises:

determining a distance between each successive pair of detector locations;

determining a difference between the total energy provided by the filter response of a detector with a respective center frequency at each successive pair of detector locations; and if the difference and the distance are each above a respective predetermined threshold, adding an additional detector location between the successive pair of detector locations.

8. The method of claim 7 wherein examining each successive pair of detector locations in the initial set of pruned detector locations to determine the enhanced set of pruned detector locations is performed iteratively.

9. The method of claim 7 wherein each one of the respective predetermined thresholds changes based on the location of each one of the successive pair of detector locations.

10. A loudness estimation apparatus comprising:

processing circuitry; and a memory storing instructions, which, when executed by the processing circuitry cause the loudness estimation apparatus to:

calculate a power spectrum from an auditory stimulus such that the power spectrum describes the auditory stimulus in terms of magnitude and frequency;

filter the power spectrum in a way that approximates a filter response of a human outer and middle ear to obtain an effective power spectrum;

calculate an intensity pattern from the effective power spectrum, the intensity pattern comprising a total intensity of the effective power spectrum within one effective rectangular bandwidth centered at each one of a plurality of detector locations within an auditory frequency range;

calculate a median intensity pattern from the intensity pattern;

determine an initial set of pruned detector locations within the auditory frequency range based on the median intensity pattern;

examine each successive pair of detector locations in the initial set of pruned detector locations to determine an enhanced set of pruned detector locations within the auditory frequency range; and calculate an excitation pattern from the effective power spectrum, the excitation pattern comprising a total energy provided by a filter response of each one of a plurality of detectors with a respective center frequency at a different one of the enhanced set of pruned detector locations.

11. The loudness estimation apparatus of claim 10 wherein examining each successive pair of detector locations in the initial set of pruned detector locations to determine the enhanced set of pruned detector locations comprises:

determining a difference between the total energy provided by the filter response of a detector with a respective center frequency at each successive pair of detector locations; and if the difference is above a predetermined threshold, adding an additional detector location between the successive pair of detector locations.

12. The loudness estimation apparatus of claim 11 wherein examining each successive pair of detector locations in the initial set of pruned detector locations to determine the enhanced set of pruned detector locations is performed iteratively.

13. The loudness estimation apparatus of claim 11 wherein the predetermined threshold changes based on the location of each one of the successive pair of detector locations.

14. The loudness estimation apparatus of claim 10 wherein examining each successive pair of detector locations in the initial set of pruned detector locations to determine the enhanced set of pruned detector locations comprises:

determining a distance between each successive pair of detector locations; and if the distance is above a predetermined threshold, adding an additional detector location between the successive pair of detector locations.

15. The loudness estimation apparatus of claim 14 wherein examining each successive pair of detector locations in the initial set of pruned detector locations to determine the enhanced set of pruned detector locations is performed iteratively.

16. The loudness estimation apparatus of claim 10 wherein examining each successive pair of detector locations in the initial set of pruned detector locations to determine the enhanced set of pruned detector locations comprises:

determining a distance between each successive pair of detector locations;

determining a difference between the total energy provided by the filter response of a detector with a respective center frequency at each successive pair of detector locations; and if the difference and the distance are each above a respective predetermined threshold, adding an additional detector location between the successive pair of detector locations.

17. The loudness estimation apparatus of claim 16 wherein examining each successive pair of detector locations in the initial set of pruned detector locations to determine the enhanced set of pruned detector locations is performed iteratively.

18. The loudness estimation apparatus of claim 16 wherein each one of the respective predetermined thresholds changes based on the location of each one of the successive pair of detector locations.

19. A method for providing loudness estimation from an auditory stimulus, comprising:

calculating a power spectrum from the auditory stimulus such that the power spectrum describes the auditory stimulus in terms of magnitude and frequency;

filtering the power spectrum in a way that approximates a filter response of a human outer and middle ear to obtain an effective power spectrum;

calculating an intensity pattern from the effective power spectrum, the intensity pattern comprising a total intensity of the effective power spectrum within one effective rectangular bandwidth centered at each one of a plurality of detector locations within an auditory frequency range;

calculating an average intensity pattern from the intensity pattern;

reducing a number of frequency components in the effective power spectrum based on the average intensity pattern;

calculating a median intensity pattern from the intensity pattern;

determining an initial set of pruned detector locations within the auditory frequency range based on the median intensity pattern;

examining each successive pair of detector locations in the initial set of pruned detector locations to determine an enhanced set of pruned detector locations within the auditory frequency range; and calculating an excitation pattern from the effective power spectrum, the excitation pattern comprising a total energy provided by a filter response of each one of a plurality of detectors with a respective center frequency at a different one of the enhanced set of pruned detector locations.

20. The method of claim 19 wherein examining each successive pair of detector locations in the initial set of pruned detector locations to determine the enhanced set of pruned detector locations comprises:

determining a distance between each successive pair of detector locations;

determining a difference between the total energy provided by the filter response of a detector with a respective center frequency at each successive pair of detector locations; and if the difference and the distance are each above a respective predetermined threshold, adding an additional detector location between the successive pair of detector locations.

* * * * *